US009984617B2

(12) United States Patent
Umezaki et al.

(10) Patent No.: US 9,984,617 B2
(45) Date of Patent: May 29, 2018

(54) DISPLAY DEVICE INCLUDING LIGHT EMITTING ELEMENT

(75) Inventors: Atsushi Umezaki, Kanagawa (JP); Ryo Arasawa, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 504 days.

(21) Appl. No.: 13/006,668

(22) Filed: Jan. 14, 2011

(65) Prior Publication Data

US 2011/0175862 A1 Jul. 21, 2011

(30) Foreign Application Priority Data

Jan. 20, 2010 (JP) ..... 2010-010287

(51) Int. Cl.
*G09G 3/3233* (2016.01)

(52) U.S. Cl.
CPC ... *G09G 3/3233* (2013.01); *G09G 2300/0861* (2013.01)

(58) Field of Classification Search
CPC .... G09G 5/00; G09G 3/30; G09G 2300/0861; G09G 3/3233; G06F 3/038
USPC ..... 345/76, 204, 213, 690, 46
See application file for complete search history.

(56) References Cited

U.S. PATENT DOCUMENTS 5,731,856 A 3/1998 Kim et al.
5,744,864 A 4/1998 Cillessen et al.
6,294,274 B1 9/2001 Kawazoe et al.
6,563,174 B2 5/2003 Kawasaki et al.
6,727,522 B1 4/2004 Kawasaki et al.
7,049,190 B2 5/2006 Takeda et al.
7,061,014 B2 6/2006 Hosono et al.
7,064,346 B2 6/2006 Kawasaki et al.
(Continued)

FOREIGN PATENT DOCUMENTS

EP 1580722 A 9/2005
EP 1 737 044 A1 12/2006
(Continued)

OTHER PUBLICATIONS

Asakuma, N. et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

(Continued)

*Primary Examiner* — Kenneth Bukowski
(74) *Attorney, Agent, or Firm* — Fish & Richardson P.C.

(57) ABSTRACT

Each of a plurality of pixels includes a transistor, a capacitor, and a display element. One terminal of the capacitor is electrically connected to a first line. The other terminal of the capacitor is electrically connected to a gate of the transistor. In a first period, a first terminal of the transistor is electrically connected to the gate of the transistor and the gate of the transistor is electrically connected to a second line. In a second period, the first terminal of the transistor is electrically connected to the gate of the transistor and a second terminal of the transistor is electrically connected to a third line. In a third period, the first terminal of the transistor is electrically connected to the first line and the second terminal of the transistor is electrically connected to the display element.

11 Claims, 35 Drawing Sheets

(56) References Cited

U.S. PATENT DOCUMENTS 7,105,868 B2 9/2006 Nause et al.
7,211,825 B2 5/2007 Shih et al.
7,282,782 B2 10/2007 Hoffman et al.
7,297,977 B2 11/2007 Hoffman et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,511,708 B2 3/2009 Numao
7,528,808 B2 5/2009 Tam
7,674,650 B2 3/2010 Akimoto et al.
7,724,245 B2 5/2010 Miyazawa
7,732,819 B2 6/2010 Akimoto et al.
8,305,304 B2 11/2012 Kimura
8,477,085 B2 7/2013 Shishido
8,791,929 B2 7/2014 Kimura
2001/0046027 A1 11/2001 Tai et al.
2002/0056838 A1 5/2002 Ogawa
2002/0132454 A1 9/2002 Ohtsu et al.
2003/0189401 A1 10/2003 Kido et al.
2003/0218222 A1 11/2003 Wager, III et al.
2004/0038446 A1 2/2004 Takeda et al.
2004/0127038 A1 7/2004 Carcia et al.
2005/0017302 A1 1/2005 Hoffman
2005/0168415 A1* 8/2005 Noda et al. ..... 345/76
2005/0199959 A1 9/2005 Chiang et al.
2005/0237273 A1* 10/2005 Ozawa ..... G09G 3/3233 345/46
2006/0028409 A1* 2/2006 Numao ..... 345/76
2006/0035452 A1 2/2006 Carcia et al.
2006/0043377 A1 3/2006 Hoffman et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0292777 A1 12/2006 Dunbar
2007/0018917 A1 1/2007 Miyazawa
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0272922 A1 11/2007 Kim et al.
2007/0273618 A1* 11/2007 Hsieh ..... G09G 3/3233 345/76
2007/0287296 A1 12/2007 Chang
2008/0006877 A1 1/2008 Mardilovich et al.
2008/0036706 A1 2/2008 Kitazawa
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0182358 A1 7/2008 Cowdery-Corvan et al.
2008/0224133 A1 9/2008 Park et al.
2008/0225061 A1* 9/2008 Kimura ..... H01L 27/1255 345/690
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0296568 A1 12/2008 Ryu et al.
2009/0009676 A1* 1/2009 Kimura ..... G09G 3/2022 349/43
2009/0068773 A1 3/2009 Lai et al.
2009/0073325 A1 3/2009 Kuwabara et al.
2009/0114910 A1 5/2009 Chang
2009/0134399 A1 5/2009 Sakakura et al.
2009/0152506 A1 6/2009 Umeda et al.
2009/0152541 A1 6/2009 Maekawa et al.
2009/0267936 A1* 10/2009 Kwon ..... 345/213
2009/0278122 A1 11/2009 Hosono et al.
2009/0280600 A1 11/2009 Hosono et al.
2009/0303213 A1* 12/2009 Kimura ..... 345/204
2010/0065844 A1 3/2010 Tokunaga
2010/0092800 A1 4/2010 Itagaki et al.
2010/0109002 A1 5/2010 Itagaki et al.
2010/0194720 A1 8/2010 Miyazawa
2014/0327663 A1 11/2014 Kimura

FOREIGN PATENT DOCUMENTS

EP 1744299 A 1/2007
EP 2 226 847 A2 9/2010
JP 60-198861 A 10/1985
JP 63-210022 A 8/1988
JP 63-210023 A 8/1988
JP 63-210024 A 8/1988
JP 63-215519 A 9/1988
JP 63-239117 A 10/1988
JP 63-265818 A 11/1988
JP 05-251705 A 9/1993
JP 08-264794 A 10/1996
JP 11-505377 A 5/1999
JP 2000-044236 A 2/2000
JP 2000-150900 A 5/2000
JP 2002-076356 A 3/2002
JP 2002-289859 A 10/2002
JP 2003-086000 A 3/2003
JP 2003-086808 A 3/2003
JP 2004-103957 A 4/2004
JP 2004-273614 A 9/2004
JP 2004-273732 A 9/2004
JP 2005-258436 A 9/2005
JP 2006-047787 A 2/2006
JP 2006-301161 A 11/2006
JP 2007-025192 A 2/2007
JP 2008-040023 A 2/2008
JP 2008-040326 A 2/2008
KR 10-0658631 12/2006
KR 2008-0056098 A 6/2008
KR 2009-0095519 A 9/2009
WO 2004/114391 A1 12/2004

OTHER PUBLICATIONS

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

(56) References Cited

OTHER PUBLICATIONS

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Cho, D et al., "21.2: AL and SN-Doped Zinc Indium Oxide Thin Film Transistors for AMOLED Back-Plane," SID Digest '09 : SID International Symposium Digest of Technical Papers, May 31, 2009, pp. 280-283.
Clark, S et al., "First Principles Methods Using CASTEP," Zeitschrift fur Kristallographie, 2005, vol. 220, pp. 567-570.
Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.
Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.
Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZnO Thin-Film Transistors Produced At Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In-Ga-Zn-O TFTs for Flat Panel Displays," AM-FPD '08 Digest of Technical Papers, Jul. 2, 2008, pp. 251-252, The Japan Society of Applied Physics.
Godo, H et al.. "P-9: Numerical Analysis on Temperature Dependence of Characteristics of Amorphous In-Ga-Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Hayashi, R et al., "42.1: Invited Paper: Improved Amorphous In-Ga-Zn-O TFTS," SID Digest '08: SID International Symposium Digest of Technical Papers, May 20, 2008, vol. 39, pp. 621-624.
Hirao, T et al., "Novel Top-Gate Zinc Oxide Thin-Film Transistors (ZnO TFTS) for AMLCDS," Journal of the SID, 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07: SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda., T et al., "Full-Functional System Liquid Crystal Display Using CG-Silicon Technology," SID Digest '04: SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08: SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09: SID International Symposium Digest of Technical Papers, May 31, 2009, pp. 983-985.
Kanno, H et al., "White Stacked Electrophosphorecent Organic Light-Emitting Devices Employing MOO3 As a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07: SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N. et al., "SPINEL,YBFE2O4, and YB2FE3O7 Types of Structures for Compounds in the IN2O3 and SC2O3-A2O3-BO Systems [A; Fe, Ga, or Al; B: Mg, Mn, Fe, Ni, Cu,or Zn] At Temperatures Over 1000° C.," Journal of Solid State Chemistry, 1985, vol. 60, pp. 382-384.
Kimizuka, N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3-ZnGa2O4-ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems." Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06: Proceedings of the 13th International Display Workshops, Dec. 7, 2006, pp. 663-666.
Lee, J et al., "World'S Largest (15-Inch) XGA AMLCD Panel Using IGZO Oxide TFT," SID Digest '08: SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09: SID International Symposium Digest of Technical Papers, May 31, 2009, pp. 191-193.
Li, C et al., "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "SUFTLA Flexible Microelectronics on Their Way to Business," SID Digest '07: SID International Symposium Digest of Technical Papers, 2007, vol. 38, pp. 1673-1676.
Mo, Y et al., "Amorphous Oxide TFT Backplanes for Large Size AMOLED Displays," IDW '08: Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3-Ga2ZnO4-ZnO system at 1350° C.," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.

(56) References Cited

OTHER PUBLICATIONS

Nomura, K et al., "Amorphous Oxide Semiconductors for High-Performance Flexible Thin-Film Transistors," Jpn. J. Appl. Phys. (Japanese Journal of Applied Physics), 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters), Sep. 13, 2004, vol. 85, No. 11, pp. 1993-1995.
Nowatari, H et al., "60.2: Intermediate Connector With Suppressed Voltage Loss for White Tandem OLEDS," SID Digest '09: SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 in. QVGA AMOLED Display Using In-Ga-Zn-Oxide TFTS With a Novel Passivation Layer," SID Digest '09: SID International Symposium Digest of Technical Papers, May 31, 2009, pp. 284-287.
Ohara, H et al., "Amorphous In-Ga-Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81. No. 5, pp. 501-515.
Orita, M et al., "Mechanism of Electrical Conductivity of Transparent InGaZnO4," Phys. Rev. B (Physical Review. B). Jan. 15, 2000, vol. 61. No. 3, pp. 1811-1816.
Osada, T et al., "15.2: Development of Driver-Integrated Panel using Amorphous In-Ga-Zn-Oxide TFT," SID Digest '09: SID International Symposium Digest of Technical Papers, May 31, 2009, pp. 184-187.
Osada, T et al., "Development of Driver-Integrated Panel Using Amorphous In-Ga-Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park. J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08: SID International Symposium Digest of Technical Papers, May 20, 2008, vol. 39, pp. 629-632.
Park, J et al., "Amorphous Indium-Gallium-Zinc Oxide TFTS and Their Application for Large Size AMOLED," AM-FPD '08 Digest of Technical Papers, Jul. 2, 2008, pp. 275-278.
Park, S et al., "Challenge to Future Displays: Transparent AM-OLED Driven by Peald Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In-Ga-Zn-Oxide TFTS," IDW '09: Proceedings of the 16th International Display Workshops, 2009, pp. 689-692.
Son, K et al., "42.4L: Late-News Paper: 4 Inch QVGA AMOLED Driven by the Threshold Voltage Controlled Amorphous Gizo (Ga2O3-In2O3-ZnO) TFT," SID Digest '08: SID International Symposium Digest of Technical Papers, May 20, 2008, vol. 39, pp. 633-636.
Takahashi, M et al., "Theoretical Analysis of IGZO Transparent Amorphous Oxide Semiconductor," IDW '08: Proceedings of the 15th International Display Workshops, Dec. 3, 2008, pp. 1637-1640.
Tsuda, K et al., "Ultra Low Power Consumption Technologies for Mobile TFT-LCDs," IDW '02: Proceedings of the 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.
Tam.S et al., "Invited Paper: Modelling and Design of Polysilicon Drive Circuits for OLED Displays", SID Digest '04: SID International Symposium Digest of Technical Papers, May 1, 2004, vol. 35, No. 1, pp. 1406-1409.
Korean Office Action (Application No. 2011-0004805) dated Jul. 4, 2017.

* cited by examiner

DISPLAY DEVICE INCLUDING LIGHT EMITTING ELEMENT

BACKGROUND OF THE INVENTION

1. Field of the Invention

The present invention relates to a display device including a light emitting element and to a driving method thereof, and particularly to a display device including a light emitting element, which is controlled by current, and to a driving method thereof.

2. Description of the Related Art

Display devices including light emitting elements have been developed. For example, a display device including a plurality of pixels each having a light emitting element and a drive transistor electrically connected to the light emitting element have been developed. In such a display device, the luminance of each pixel is controlled by controlling the amount of current flowing through a light emitting element with the use of a drive transistor.

The threshold voltage (hereinafter referred to as Vth) of a drive transistor, however, might vary between pixels. For this reason, a threshold voltage compensating pixel circuit, which compensates variations in Vth of a drive transistor, has been researched. A display device with a threshold voltage compensating pixel circuit in which a drive transistor is a diode-connected transistor has been researched, for example (see Patent Document 1).

A pixel circuit described in Patent Document 1 has a drive transistor Q1 which is a diode-connected transistor whose gate and source are connected to each other. Moreover, the pixel circuit includes a capacitor C2, a signal line Ui, and a signal line Sj. A gate of the drive transistor Q1 is electrically connected to one terminal of the capacitor C2; the other terminal of the capacitor C2 is electrically connected to the signal line Ui; and a drain of the drive transistor Q1 is electrically connected to the signal line Sj. The display device having the pixel circuit described in Patent Document 1 is capable of changing the potential of the signal line Ui in three levels, and capable of compensating Vth of the drive transistor Q1 by changing the potential of the other terminal of the capacitor C2 while applying a predetermined potential to the drain of the drive transistor Q1.

REFERENCE

[Patent Document 1] Japanese Published Patent Application No. 2006-047787

SUMMARY OF THE INVENTION

The display device having the pixel circuit described in Patent Document 1, however, needs the signal line Ui in addition to the signal line Sj, leading to an increase in power consumption. Moreover, the amplitude voltage of the signal line Ui needs to be increased, leading to an increase in power consumption. Further, the display device needs a control circuit for the signal line Ui, leading to an increase in circuit size. Of particular note is that the potential of the signal line Ui needs to be changed in three levels. This makes it difficult for the control circuit for the signal line Ui to be a digital circuit; thus, the size of the control circuit is further increased. Furthermore, the signal lines Ui need to be controlled at different timings per row. For this reason, when the signal lines Ui are controlled by an external circuit, the number of connection points between a substrate with the pixel circuit and the external circuit is increased. For example, when the pixel circuits are provided in 640 rows, the number of connection points increases by 640.

In view of this, an object is to provide a display device in which the influence of variations in Vth of a drive transistor can be reduced, power consumption is reduced, and the size of a circuit and the number of connection points are not increased.

One embodiment of the present invention includes a plurality of pixels. Each of the plurality of pixels includes a transistor, a capacitor, and a display element. One terminal of the capacitor is electrically connected to a first line. The other terminal of the capacitor is electrically connected to a gate of the transistor. In a first period, a first terminal of the transistor is electrically connected to the gate of the transistor and the gate of the transistor is electrically connected to a second line. In a second period, the first terminal of the transistor is electrically connected to the gate of the transistor and a second terminal of the transistor is electrically connected to a third line. In a third period, the first terminal of the transistor is electrically connected to the first line and the second terminal of the transistor is electrically connected to the display element. In the first to third periods, a fixed potential is applied to the first line.

One embodiment of the present invention includes a plurality of pixels. Each of the plurality of pixels includes a transistor, a capacitor, and a display element. One terminal of the capacitor is electrically connected to a first line. The other terminal of the capacitor is electrically connected to a gate of the transistor. In a first period, a first terminal of the transistor is electrically connected to the gate of the transistor, the first terminal of the transistor is electrically disconnected from the first line, the gate of the transistor is electrically connected to a second line, a second terminal of the transistor is electrically disconnected from a third line, and the second terminal of the transistor is electrically disconnected from the display element. In a second period, the first terminal of the transistor is electrically connected to the gate of the transistor, the first terminal of the transistor is electrically disconnected from the first line, the gate of the transistor is electrically disconnected from the second line, the second terminal of the transistor is electrically connected to the third line, and the second terminal of the transistor is electrically disconnected from the display element. In a third period, the first terminal of the transistor is electrically disconnected from the gate of the transistor, the first terminal of the transistor is electrically connected to the first line, the gate of the transistor is electrically disconnected from the second line, the second terminal of the transistor is electrically disconnected from the third line, and the second terminal of the transistor is electrically connected to the display element. In the first to third periods, a fixed potential is applied to the first line.

One embodiment of the present invention includes a plurality of pixels. Each of the plurality of pixels includes a transistor, a capacitor, a display element, and first to fifth switches. One terminal of the capacitor is electrically connected to a first line. The other terminal of the capacitor is electrically connected to a gate of the transistor. A first terminal of the transistor is electrically connected to the gate of the transistor through the first switch. The first terminal of the transistor is electrically connected to the first line through the second switch. The gate of the transistor is electrically connected to a second line through the third switch. A second terminal of the transistor is electrically connected to a third line through the fourth switch. The second terminal of the transistor is electrically connected to the display element through the fifth switch. In the first to third periods, a fixed potential is applied to the first line.

According to the above embodiments, a video signal is input to the third line, and a fixed potential is applied to the second line.

In this specification, the term "connected" may mean "electrically connected", for example. Therefore, the description "A and B are connected to each other" means that one or more of elements each of which enables electrical connection between A and B (e.g. switches, transistors, capacitors, resistors, and diodes) can be connected between A and B.

The present invention can provide, by the above configuration, a display device in which the influence of variations in Vth of a drive transistor can be reduced, power consumption is reduced, and the size of a circuit and the number of connection points are not increased.

DETAILED DESCRIPTION OF THE INVENTION

Figure 1A:
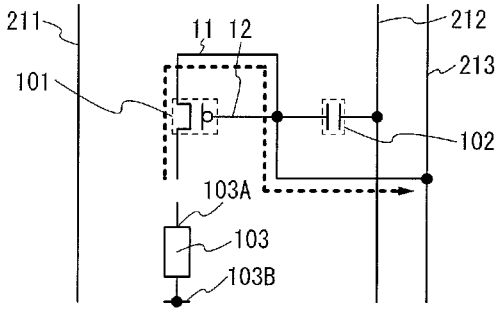
FIGS. 1A to 1C are an example of diagrams showing circuit configurations and driving methods (operations) of a pixel included in a display device.

Hereinafter, embodiments of the present invention will be described with reference to the drawings. However, the present invention is not limited to the following description. The present invention can be implemented in various ways and it will be readily appreciated by those skilled in the art that various changes and modifications are possible without departing from the spirit and the scope of the present invention. Therefore, unless such changes and modifications depart from the scope of the invention, they should be construed as being included therein. Note that reference numerals denoting the same portions are commonly used in different drawings.

Embodiment 1

In this embodiment, an example of a display device using a light emitting element as a display element, and an example of the driving method thereof will be described. Although a display device in this embodiment includes a plurality of pixels, an example of a circuit configuration of a single pixel and an example of the driving method thereof will be described below. Note that the plurality of pixels included in the display device in this embodiment has the same circuit configuration and employs the same driving method. The circuit configuration and the driving method below can therefore be applied to other pixels included in the display device in this embodiment.

Figure 1B:
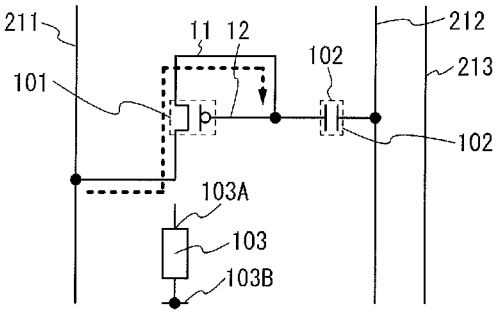
Figure 1C:
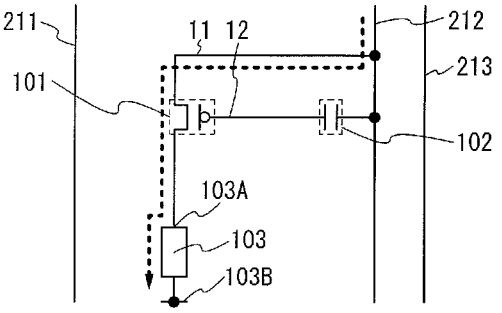

A pixel included in the display device in this embodiment will be described with reference to FIGS. 1A to 1C. FIGS. 1A to 1C are diagrams showing an example of circuit configurations of the pixel and the driving method (operation) thereof. FIG. 1A shows an example of the operation of initializing the pixel and a circuit diagram at the time. FIG.

1B shows an example of the operation of applying a video signal to the pixel and a circuit diagram at the time. FIG. 1C shows an example of the operation of displaying an image in accordance with the video signal and a circuit diagram at the time.

The pixel included in the display device in this embodiment includes a transistor 101, a capacitor 102, and a display element 103. The transistor 101 has a gate, a source, and a drain. The function of a source and the function of a drain may be interchanged depending on the conductivity type of transistors employed or depending on the direction of current flow induced by the circuit operation. Therefore, in this specification, one of a source and a drain is referred to as a first terminal and the other, a second terminal. Two electrodes of the capacitor 102 are referred to as a first terminal and a second terminal. The display element 103 can have an electrode 103A and an electrode 103B. The display element 103 can be a light emitting element, which is controlled by current, such as an EL element.

The circuit configuration and operation shown in FIG. 1A will be described. FIG. 1A shows an example of the case where the pixel is initialized. Note that the description "there is continuity between A and B" means that A and B are electrically connected to each other, and the description "there is no continuity between A and B" means that A and B are electrically disconnected from each other.

In FIG. 1A, continuity between a first terminal of the transistor 101 and a gate of the transistor 101 is established. Continuity between the gate of the transistor 101 and a line 213 is established. Continuity between the first terminal of the capacitor 102 and a line 212 is established. Continuity between the second terminal of the capacitor 102 and the gate of the transistor 101 is established. In addition, continuity between the first terminal of the transistor 101 and the line 212 is broken. Continuity between a second terminal of the transistor 101 and the first electrode 103A of the display element 103 is broken. Continuity between the second terminal of the transistor 101 and a line 211 is broken. Fixed potentials V2 and V3 are applied to the line 212 and the line 213, respectively. Consequently, the potential of the first terminal of the transistor 101 (V11) and the potential of the gate of the transistor 101 (V12) become approximately the same as the potential of the line 213 (V3). Further, the potential of the first terminal of the capacitor 102 becomes approximately the same as the potential of the line 212 (V2).

Note that when the potential of the first terminal of the transistor 101 (V11) and the potential of the gate of the transistor 101 (V12) become approximately the same as the potential of the line 213 (V3), the transistor 101 is turned on. Then, the potential of the second terminal of the transistor 101 starts to decrease. When the potential of the second terminal of the transistor 101 decreases to V3−|Vth101|, the transistor 101 is turned off.

The circuit configuration and operation shown in FIG. 1B will be described. FIG. 1B shows an example of the case where a video signal is applied to the pixel.

In FIG. 1B, continuity between the first terminal of the transistor 101 and the gate of the transistor 101 remains established. Continuity between the second terminal of the transistor 101 and the line 211 is established. Continuity between the first terminal of the capacitor 102 and the line 212 remains established. Continuity between the second terminal of the capacitor 102 and the gate of the transistor 101 remains established. In addition, continuity between the first terminal of the transistor 101 and the line 212 remains broken. Continuity between the second terminal of the transistor 101 and the first electrode 103A of the display element 103 remains broken. A video signal Vdata is applied to the line 211. Consequently, the potential of the second terminal of the transistor 101 becomes approximately the same as the potential of the line 211 (Vdata). The potential of the line 211 (Vdata or the potential of a video signal) can be higher than the potential of the first terminal of the transistor 101 (V11), and higher than the potential of the gate of the transistor 101 (V12). Thus, the transistor 101 is turned on, so that continuity between the line 211, the first terminal of the transistor 101, and the gate of the transistor 101 is established. Then, the potential of the first terminal of the transistor 101 (V11) and the potential of the gate of the transistor 101 (V12) start to increase from V3. Then, the potential of the first terminal of the transistor 101 (V11), and the potential of the gate of the transistor 101 (V12) increase to Vdata−|Vth101| (Vth101 is the threshold voltage of the transistor 101). Consequently, the transistor 101 is turned off, so that continuity between the line 211, the first terminal of the transistor 101, and the gate of the transistor 101 is broken. Thus, the potential of the first terminal of the transistor 101 (V11), and the potential of the gate of the transistor 101 (V12) each become approximately Vdata−|Vth101|. At this time, the capacitor 102 can hold a potential difference between the gate of the transistor 101 and the line 212.

The circuit configuration and operation shown in FIG. 1C will be described. FIG. 1C shows an example of the case of displaying an image in accordance with a video signal.

In FIG. 1C, continuity between the first terminal of the transistor 101 and the line 212 is established. Continuity between the second terminal of the transistor 101 and the first electrode 103A of the display element 103 is established. Continuity between the first terminal of the capacitor 102 and the line 212 remains established. Continuity between the second terminal of the capacitor 102 and the gate of the transistor 101 remains established. In addition, continuity between the first terminal of the transistor 101 and the gate of the transistor 101 is broken. Continuity between the second terminal of the transistor 101 and the line 211 is broken. The fixed potential V2 is applied to the line 212. Consequently, the potential of the first terminal of the transistor 101 (V11) becomes approximately the same as the potential of the line 212 (V2). At this time, the potential of the gate of the transistor 101 (potential V12) is kept approximately Vdata−|V101| by the capacitor 102. Consequently, a potential difference between the gate and the source of the transistor 101 (Vgs) becomes approximately Vdata−|Vth101|−V2. Thus, when the transistor 101 operates in the saturation region, a drain current of the transistor 101, that is, the value of a current that flows through the display element 103 can be independent of the threshold voltage of the transistor 101. Thus, it is possible to compensate the threshold voltage of the transistor 101 and display an image in accordance with a video signal Vdata.

Figure 2:
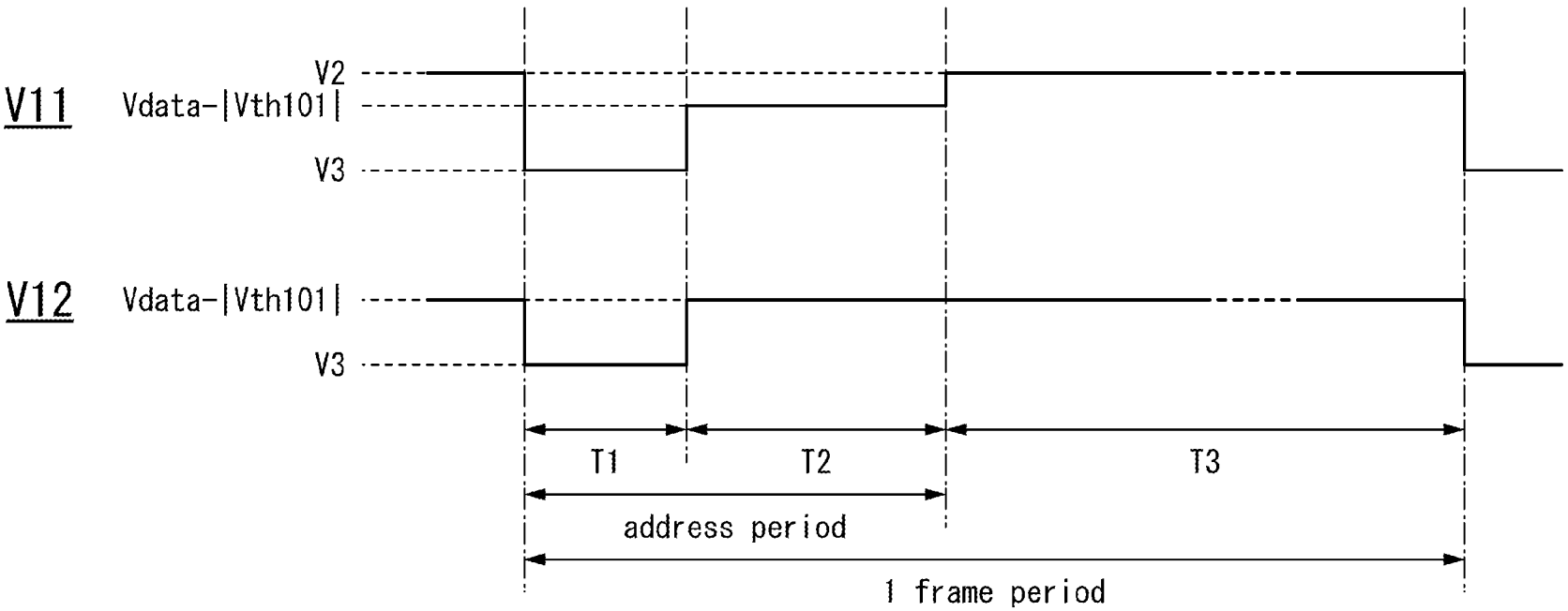
FIG. 2 is an example of a timing chart applicable to the pixel included in the display device.

FIG. 2 shows an example of a timing chart applicable to the pixel included in the display device in this embodiment. The timing chart in FIG. 2 includes a period T1, a period T2, and a period T3. A combination of the period T1 and the period T2 is an addressing period. A combination of the period T1, the period T2, and the period T3 is one frame period. The timing chart of FIG. 2 shows an example of a potential of a node 11 (V11) and a potential of the node 12 (V12). The node 11 is a node connected to the first terminal of the transistor 101. The node 12 is a node connected to the gate of the transistor 101.

In FIG. 2, the potential V3 is the potential of the line 213. The potential V2 is the potential of the line 212. The potential Vdata is the potential of a signal input to the line 211. The potential V2 and the potential V3 are fixed potentials. The potential V2 can be a value higher than or approximately the same as the maximum value of the potential Vdata. The potential V3 can be a value lower than the potential V2. In addition, the potential V3 can be lower than or approximately the same as the minimum value of the potential Vdata.

The period T1 in FIG. 2 is a period in which the operation shown in FIG. 1A is performed. In the period T1, the potential of the node 11, that is, the potential of the first terminal of the transistor 101 (V11), and the potential of the node 12, that is, the potential of the gate of the transistor 101 (V12) are approximately the same as the potential of the line 213 (V3).

Next, the operation in the period T2 will be described. The period T2 in FIG. 2 is a period in which the operation shown in FIG. 1B is performed. In the period T2, the potential of the node 11 (V11) and the potential of the node 12 (V12) increase to Vdata−|Vth101|.

Next, the period T3 will be described. The period T3 in FIG. 2 is a period in which the operation shown in FIG. 1C is performed. In the period T3, the potential of the node 11 (V11) is approximately the same as the potential of the line 212 (V2). The potential of the node 12 (V12) is kept approximately Vdata−|Vth101| by the capacitor 102.

In the pixel included in the display device in this embodiment, the transistor 101 can have a function of supplying a current to the display element 103. The value of such a current can be set in accordance with a potential difference between the gate and the source of the transistor 101 (Vgs) in many cases. The transistor 101 can therefore serve as a drive transistor for the display element 103.

The transistor 101 can be a p-channel transistor. A p-channel transistor turns on when its Vgs becomes lower than its Vth. Note that the transistor 101 can be an n-channel transistor instead. An n-channel transistor turns on when its Vgs becomes higher than its Vth.

When an n-channel transistor is used, the transistor can be operated by setting the polarity of the potential in reverse to the case of using a p-channel transistor. In this case, the circuit configuration is changed as appropriate in order to obtain the polarity of the potential reverse to that in a circuit using a p-channel transistor.

The capacitor 102 can have a function of keeping the potential of the gate of the transistor 101. In other words, the capacitor 102 can have a function of holding Vgs of the transistor 101. That is, the capacitor 102 can serve as a storage capacitor.

The display element 103 can have the electrode 103A and the electrode 103B. The display element 103 can be a light emitting element such as an EL element. Note that the display element 103 can have three electrodes.

The electrodes 103B in the plurality of pixels included in the display device can be connected to each other. In other words, the electrode 103B can serve as a common electrode, a counter electrode, a cathode, or the like.

The fixed potential V1 is applied to the electrode 103B. The potential V1 can serve as a potential applied to a common electrode, a cathode, or the like. Note that a signal can be also input to the electrode 103B. Thus, the display element 103 can be reverse-biased.

The electrode 103A can serve as a pixel electrode.

The potential of a signal Vdata is input to the line 211. The potential Vdata can serve as a video signal. In other words, the line 211 can serve as a signal line, a video signal line, or a source signal line. In addition, the potential Vdata is an analog signal. Note that the potential Vdata can be a digital signal instead. By employing a digital signal as the potential Vdata, digital time grayscale can be achieved.

The fixed potential V2 is applied to the line 212. The potential V2 can serve as an anode potential. The line 212 can serve as a power supply line or an anode line. The potential V2 can be higher than the potential V1 (V2>V1). Note that when the anode and the cathode of the display element 103 are interchanged, the potential V2 can be lower than the potential V1.

The fixed potential V3 is applied to the line 213. The potential V3 can serve as an initialization potential or a reference potential. The line 213 can serve as a power supply line or an initialization line. In addition, the potential V3 can be lower than the potential V2 (V3<V2). Alternatively, the potential V3 can be lower than or approximately the same as the minimum value of the potential Vdata. Alternatively, the potential V3 can be approximately the same as the potential V1. Thus, the number of the types of potential can be reduced, thereby simplifying the configuration of a power supply circuit.

In addition, the pixel included in the display device in this embodiment can include another element such as a switch, a transistor, a diode, or a capacitor.

Further, the display device in this embodiment can have a plurality of primary colors (e.g. red, blue, green, white, yellow, magenta, cyan, or the like). In this case, the pixels of the display device in this embodiment can be categorized by the plurality of primary colors.

In this case, the channel width (W), the channel length (L), or the W/L ratio of the transistor 101 can be varied among the pixels by primary color. For example, the W/L ratio of the transistor 101 in a pixel belonging to a green group can be smaller than that of the transistor 101 in a pixel belonging to a red (or blue) group. Consequently, the balance of luminous efficacy among display elements belonging to a red group, display elements belonging to a blue group, and display elements belonging to a green group can be adjusted without changing the value of a video signal. As a result, the configuration of a circuit (e.g. a source driver) which inputs a video signal to the pixels can be simplified. Alternatively, the number of power sources or signals required for a circuit (e.g. a source driver) which inputs a video signal to the pixels can be reduced.

The value of a potential applied to the line 212 can be varied among the pixels by primary color. Consequently, the balance of luminous efficacy among a display element belonging to a red group, a display element belonging to a blue group, and a display element belonging to a green group can be adjusted without changing the value of a video signal.

According to this embodiment, it is possible to reduce the influence of variations in Vth of the transistor 101 (the drive transistor) and provide a display device capable of controlling the luminance of each pixel without being influenced by variations in Vth of the transistor 101. A fixed potential is applied to the line 212 and the line 213 used for correcting Vth. Thus, a display device in which power consumption is reduced, and the size of a circuit and the number of connection points are not increased can be provided.

This embodiment can be freely combined with any of the other embodiments.

Embodiment 2

Figure 3A:
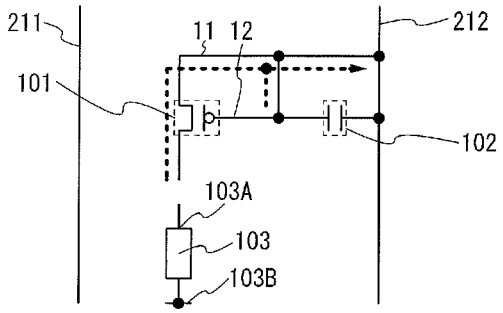
FIGS. 3A to 3C are an example of diagrams showing circuit configurations and driving methods of a pixel included in a display device.
Figure 3B:
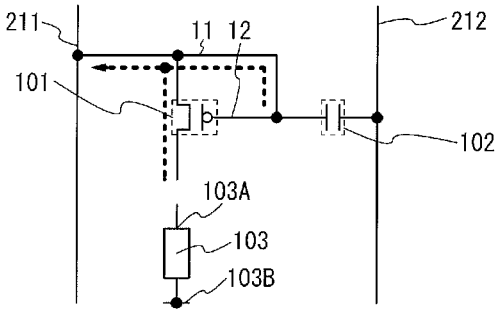
Figure 3C:
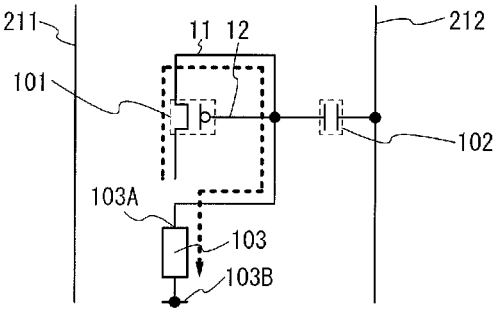

A pixel of a display device in this embodiment will be described with reference to FIGS. 3A to 3C. FIGS. 3A to 3C are diagrams showing an example of the circuit configuration of the pixel and the driving method (operation) thereof, which are different from those in FIG. 1A. Differences between FIGS. 3A to 3C and FIG. 1A will be described below, and the description of common points therebetween will be omitted.

The circuit configuration and operation shown in FIG. 3A will be described. FIG. 3A shows an example of the case where the pixel is initialized. In FIG. 3A, continuity between the gate of the transistor 101 and the line 212 is established. FIG. 3A is different from FIG. 1A in not having the line 213. In this period (the period T1), the potential of the line 212 can be V3. Consequently, in the period T1, the potential of the first terminal of the transistor 101 (V11), and the potential of the gate of the transistor 101 (V12) become approximately the same as the potential of the line 212 (V3). Thus, the line 213 can be omitted. As a result, improvement in aperture ratio, improvement in yield, a reduction in manufacturing cost, or the like can be achieved.

In FIG. 3A, the line 212 can be perpendicular to the line 211. In this case, the line 212 is placed in the row direction. Consequently, the pixels can be controlled per row, and line sequential drive can thus be achieved.

The circuit configuration and operation shown in FIG. 3B will be described. FIG. 3B shows an example of the case where the pixel is initialized. In FIG. 3B, continuity between the gate of the transistor 101 and the line 211 is established. FIG. 3B is different from FIG. 1A in not having the line 213. In this period (the period T1), the potential of the line 211 can be V3. Consequently, in the period T1, the potential of the first terminal of the transistor 101 (V11) and the potential of the gate of the transistor 101 (V12) become approximately the same as the potential of the line 211 (V3). Thus, the line 213 can be omitted. As a result, improvement in aperture ratio, improvement in yield, a reduction in manufacturing cost, or the like can be achieved.

The circuit configuration and operation shown in FIG. 3C will be described. FIG. 3C shows an example of the case where the pixel is initialized. In FIG. 3C, continuity between the gate of the transistor 101 and the electrode 103A of the display element 103 is established. FIG. 3C is different from FIG. 1A in not having the line 213. In this case, charge stored in the capacitor 102 is released by the display element 103, the potential of the first terminal of the transistor 101 (V11) and the potential of the gate of the transistor 101 (V12) decrease. Thus, the potential of the first terminal of the transistor 101 (V11) and the potential of the gate of the transistor 101 (V12) are set lower than a predetermined potential (e.g. lower than Vdata or V1+Vth103 (Vth103 is the threshold voltage of the display element 103). Thus, the line 213 can be omitted. As a result, improvement in aperture ratio, improvement in yield, a reduction in manufacturing cost, or the like can be achieved.

Operations performed afterward, that is, an operation for applying a video signal to the pixel and an operation for displaying an image in accordance with the video signal are similar to those shown in FIG. 1B and FIG. 1C. The configurations at the time is the same as that shown in FIG. 1B and FIG. 1C except that the line 213 is omitted.

This embodiment can be freely combined with any of the other embodiments.

Embodiment 3

Figure 4A:
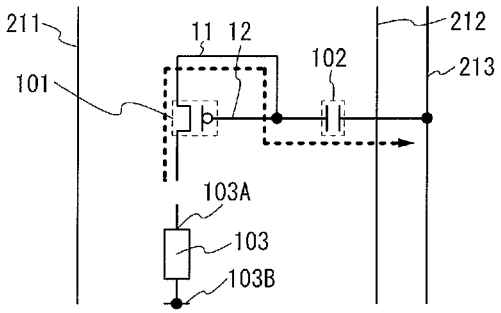
FIGS. 4A to 4C are an example of diagrams showing circuit configurations and driving methods of a pixel included in a display device.
Figure 4B:
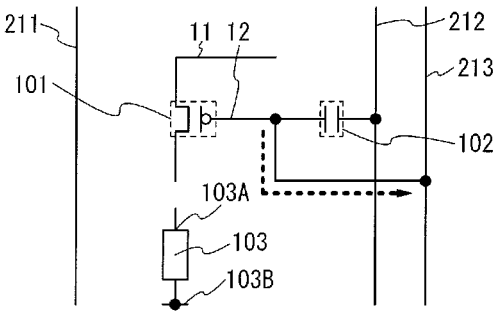
Figure 4C:
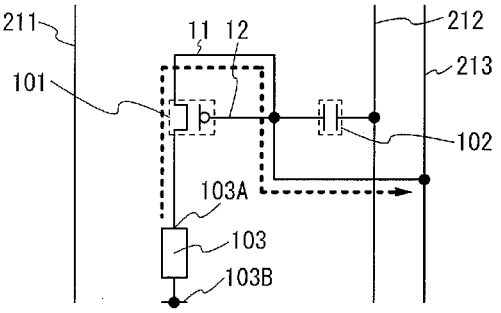

The pixel included in the display device in this embodiment will be described with reference to FIGS. 4A to 4C. FIGS. 4A to 4C are diagrams showing an example of the circuit configuration of the pixel and the driving method (operation) thereof, which are different from those in FIG. 1A. Differences between FIGS. 4A to 4C and FIG. 1A will be described below, and the description of common points therebetween will be omitted.

The circuit configuration and operation shown in FIG. 4A will be described. FIG. 4A shows an example of the case where the pixel is initialized. In FIG. 4A, continuity between the first terminal of the capacitor 102 and the line 213 is established, and continuity between the gate of the transistor 101 and the line 213 is broken. This is a point different from FIG. 1A. The potential of the line 213 decreases at the timing when the period shifts from the period T3 to the period T1. Consequently, the potential of the first terminal of the transistor 101 (V11) and the potential of the gate of the transistor 101 (V12) decrease because of capacitive coupling of the capacitor 102. The potential of the first terminal of the transistor 101 (V11) and the potential of the gate of the transistor 101 (V12) are thereby set to predetermined values (e.g. values lower than Vdata). By controlling, as described above, the potential of the first terminal of the transistor 101 (V11) and the potential of the gate of the transistor 101 (V12) with the use of capacitive coupling of the capacitor 102, the number of transistors, switches, and the like can be reduced. A circuit for controlling the conduction state of a transistor or a switch can therefore be omitted. This simplifies the configuration of a circuit for driving the pixel in this embodiment.

In FIG. 4A, the line 213 can be perpendicular to the line 211. In this case, the line 213 is placed in the row direction. Consequently, the pixels can be controlled per row, and line sequential drive can thus be achieved.

The circuit configuration and operation shown in FIG. 4B will be described. FIG. 4B shows an example of the case where the pixel is initialized. In FIG. 4B, continuity between the first terminal of the transistor 101 and the gate of the transistor 101 is broken. This is a point different from FIG. 1A.

The circuit configuration and operation shown in FIG. 4C will be described. FIG. 4C shows an example of the case where the pixel is initialized. In FIG. 4C, continuity between the second terminal of the transistor 101 and the electrode 103A of the display element 103 is established. This is a point different from FIG. 1A. In this case, the potential of the first terminal of the transistor 101 (V11), and the potential of the gate of the transistor 101 (V12) are preferably set so that the potential of the electrode 103A may be lower than the potential of the electrode 103B. Consequently, it is possible to prevent a current from being generated in the display element 103 and the display element 103 from emitting faint light. Further, since the display element 103 can be reverse-biased, Defects in the display element 103 can be removed or the lifetime of the display element 103 can be improved. Note that in FIG. 1B, FIG. 3A, FIG. 3B, FIG. 4A, and FIG. 4B, continuity between the second terminal of the transistor 101 and the electrode 103A of the display element 103 can be established.

Operations performed afterward, that is, an operation for applying a video signal to the pixel and an operation for displaying an image in accordance with the video signal are similar to those shown in FIG. 1B and FIG. 1C. The configurations at the time are also the same as those shown in FIG. 1B and FIG. 1C.

This embodiment can be freely combined with any of the other embodiments.

Embodiment 4

The pixel included in the display device in this embodiment will be described with reference to FIG. 5, FIG. 6, FIG.

Figure 7:
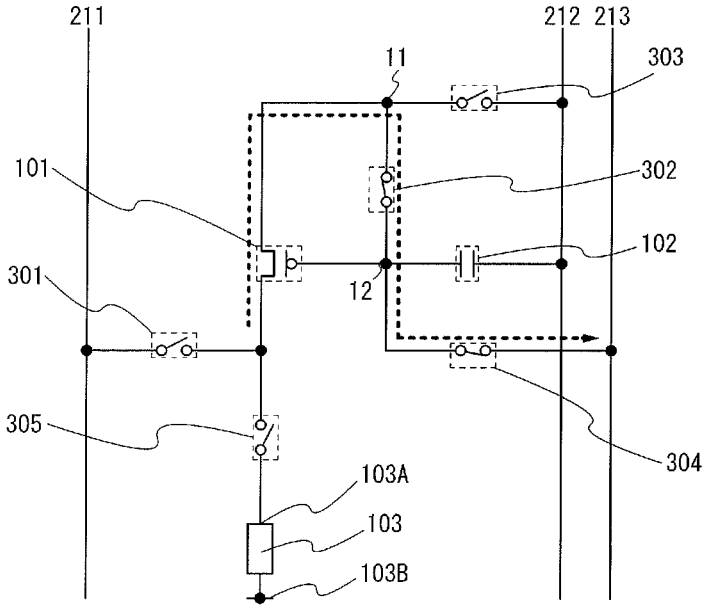
FIG. 7 is an example of a diagram showing a circuit configuration and a driving method (an operation) of a pixel included in a display device.
Figure 8:
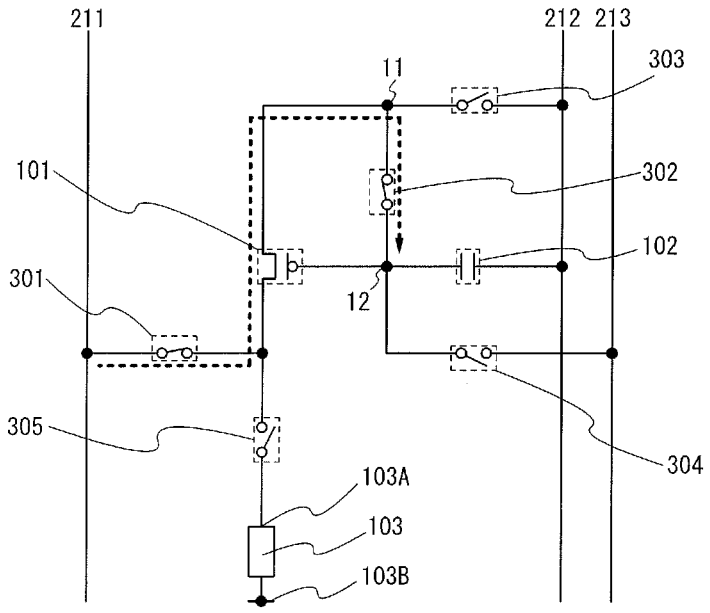
FIG. 8 is an example of a diagram showing a circuit configuration and a driving method (an operation) of the pixel included in the display device.
Figure 9:
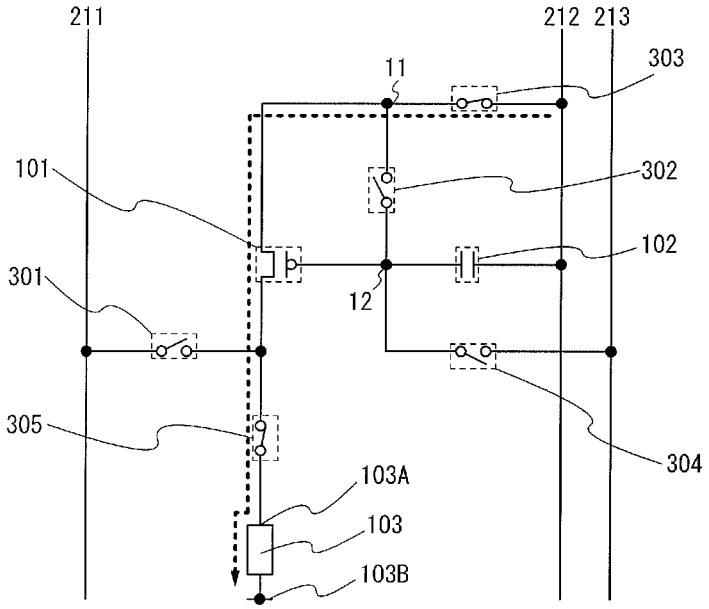
FIG. 9 is an example of a diagram showing a circuit configuration and a driving method (an operation) of the pixel included in the display device.

7, FIG. 8, and FIG. 9. FIG. 5 shows an example of a circuit configuration of a pixel that can achieve the operation shown in FIGS. 1A to 1C. FIG. 6 is an example of the timing chart applicable to the pixel shown in FIG. 5. FIG. 7, FIG. 8, and FIG. 9 each show an example of the operation of the pixel shown in FIG. 5 which is performed in each period.

Figure 5:
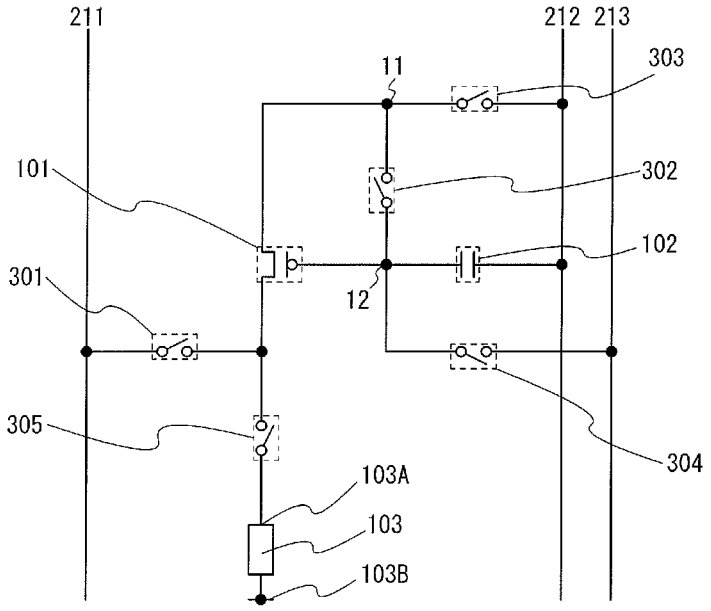
FIG. 5 is an example of a diagram showing a circuit configuration of a pixel included in a display device.

The pixel shown in FIG. 5 includes a switch 301, a switch 302, a switch 303, a switch 304, and a switch 305, in addition to the transistor 101, the capacitor 102, and the display element 103. The switch 301 is electrically connected between the second terminal of the transistor 101 and the line 211. The switch 302 is electrically connected between the first terminal of the transistor 101 and the gate of the transistor 101. The switch 303 is electrically connected between the first terminal of the transistor 101 and the line 212. The switch 304 is electrically connected between the gate of the transistor 101 and the line 213. The switch 305 is electrically connected between the second terminal of the transistor 101 and the electrode 103A of the display element 103.

Figure 6:
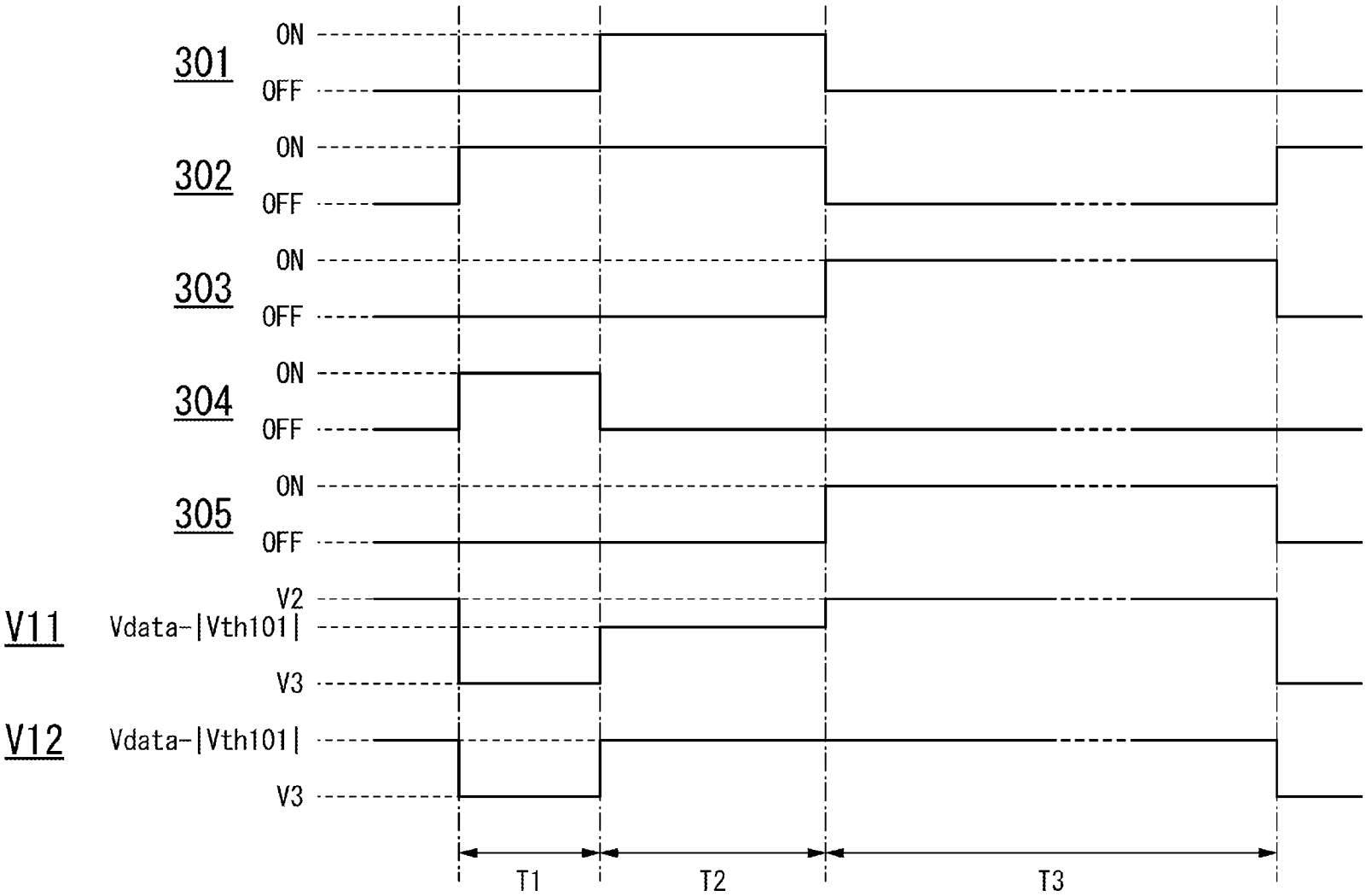
FIG. 6 is an example of a timing chart applicable to the pixel included in the display device.

FIG. 6 shows an example of a timing chart applicable to the pixel shown in FIG. 5. The timing chart in FIG. 6 includes a period T1, a period T2, and a period T3. The timing chart in FIG. 6 shows an example of the timing when the switches 301 to 305 are turned on and off, in addition to the potential of the node 11 (V11) and the potential of the node 12 (V12). The node 11 is a node connected to the first terminal of the transistor 101. The node 12 is a node connected to the gate of the transistor 101.

The operations of the pixel performed in the periods T1 to T3 will be described with reference to FIG. 6, FIG. 7, FIG. 8, and FIG. 9.

In the period T1 in FIG. 6, an operation for initializing the pixel is performed. FIG. 7 shows an example of the operation of the pixel performed in the period T1. In the period T1, the switch 301 is turned off, the switch 302 is turned on, the switch 303 is turned off, the switch 304 is turned on, and the switch 305 is turned off (see FIG. 6 and FIG. 7). Consequently, continuity between the first terminal of the transistor 101 and the gate of the transistor 101 is established. Continuity between the gate of the transistor 101 and a line 213 is established. Continuity between the first terminal of the capacitor 102 and a line 212 is established. Continuity between the second terminal of the capacitor 102 and the gate of the transistor 101 is established. In addition, continuity between the first terminal of the transistor 101 and the line 212 is broken. Continuity between the second terminal of the transistor 101 and the first electrode 103A of the display element 103 is broken. Continuity between the second terminal of the transistor 101 and a line 211 is broken. Fixed potentials V2 and V3 are applied to the line 212 and the line 213, respectively. Consequently, the potential of the first terminal of the transistor 101 (V11) and the potential of the gate of the transistor 101 (V12) become approximately the same as the potential of the line 213 (V3). Further, the potential of the first terminal of the capacitor 102 becomes approximately the same as the potential of the line 212 (V2).

In the period T2 in FIG. 6, an operation for applying a video signal to the pixel is performed. FIG. 8 shows an example of the operation of the pixel performed in the period T2. In the period T2, the switch 301 is turned on, the switch 302 remains on, the switch 303 remains off, the switch 304 is turned off, and the switch 305 remains off (see FIG. 6 and FIG. 8). Consequently, continuity between the first terminal of the transistor 101 and the gate of the transistor 101 remains established. Continuity between the second terminal of the transistor 101 and the line 211 is established. Continuity between the first terminal of the capacitor 102 and the line 212 remains established. Continuity between the second terminal of the capacitor 102 and the gate of the transistor 101 remains established. In addition, continuity between the first terminal of the transistor 101 and the line 212 remains broken. Continuity between the second terminal of the transistor 101 and the first electrode 103A of the display element 103 remains broken. A video signal Vdata is applied to the line 211.

Consequently, the potential of the second terminal of the transistor 101 becomes approximately the same as the potential of the line 211 (Vdata). The potential of the line 211 (Vdata or the potential of a video signal) can be higher than the potential of the first terminal of the transistor 101 (V11), and higher than the potential of the gate of the transistor 101 (V12). Thus, the transistor 101 is turned on, so that continuity between the line 211, the first terminal of the transistor 101, and the gate of the transistor 101 is established. Then, the potential of the first terminal of the transistor 101 (V11), and the potential of the gate of the transistor 101 (V12) start to increase from V3. Then, the potential of the first terminal of the transistor 101 (V11), and the potential of the gate of the transistor 101 (V12) increase to Vdata−|Vth101| (Vth101 is the threshold voltage of the transistor 101). Consequently, the transistor 101 is turned off, so that continuity between the line 211, the first terminal of the transistor 101, and the gate of the transistor 101 is broken. Thus, the potential of the first terminal of the transistor 101 (V11), and the potential of the gate of the transistor 101 (V12) each become approximately Vdata−|Vth101|. At this time, the capacitor 102 can hold a potential difference between the gate of the transistor 101 and the line 212.

In the period T3 in FIG. 6, an operation for displaying an image in accordance with a video signal is performed. FIG. 9 shows an example of the operation of the pixel performed in the period T3. In the period T3, the switch 301 is turned off, the switch 302 is turned off, the switch 303 is turned on, the switch 304 remains off, and the switch 305 is turned on (see FIG. 6 and FIG. 8). Consequently, continuity between the first terminal of the transistor 101 and the line 212 is established. Continuity between the second terminal of the transistor 101 and the first electrode 103A of the display element 103 is established. Continuity between the first terminal of the capacitor 102 and the line 212 remains established. Continuity between the second terminal of the capacitor 102 and the gate of the transistor 101 remains established. In addition, continuity between the first terminal of the transistor 101 and the gate of the transistor 101 is broken. Continuity between the second terminal of the transistor 101 and the line 211 is broken. The fixed potential V2 is applied to the line 212.

Consequently, the potential of the first terminal of the transistor 101 (V11) becomes approximately the same as the potential of the line 212 (V2). At that time, the potential of the gate of the transistor 101 (potential V12) is kept approximately Vdata−|Vth101| by the capacitor 102. Consequently, a potential difference between the gate and the source of the transistor 101 (Vgs) becomes approximately Vdata−|Vth101|−2. Thus, when the transistor 101 operates in the saturation region, a drain current of the transistor 101, that is, a current that flows through the display element 103 can be a value that is independent of the threshold voltage of the transistor 101. Thus, it is possible to compensate the threshold voltage of the transistor 101 and display an image in accordance with a video signal Vdata.

The switches 301 to 305 can be transistors. The transistors for the switches 301 to 305 may be of the same conductivity type (e.g. p-type or n-type). Alternatively, one or some of the transistors for the switches 301 to 305 may be of a different conductivity type from the others. For example, a situation where the switch 301, the switch 304, and the switch 305 are n-channel transistors, and the switch 302 and the switch 303 are p-channel transistors is possible. The switch 303 is connected to the line 212 that is high, and thus is preferably a p-channel transistor. Thus, the source of the transistor can be set at high potential, so that the absolute value of Vgs can be increased. The switch 303 can therefore operate accurately as a switch. The switch 304 is connected to the line 213 that is at low potential, and thus is preferably an n-channel transistor. Thus, the source of the transistor can be set at low potential, so that Vgs can be increased. The switch 304 can therefore operate accurately as a switch. The switch 301, the switch 302, and the switch 305 each can be either a p-channel transistor or an n-channel transistor.

Channel formation regions of the switches 301 to 305 may be made of the same material. Alternatively, the channel formation regions of one or some of the switches 301 to 305 may be made of a material different from those of the others. When these channel formation regions are made of different materials, either the case where the type of the materials is different or the case where the crystallinity of the materials is different while the type of the materials is the same is acceptable. The channel formation regions of the transistors for the switches 301 to 305 can be formed using, for example, silicon or another material. The other material can be an oxide semiconductor, for example. In addition, the channel formation regions of one or more of the switches 301 to 305 can be formed using silicon, and the channel formation regions of the other of the switches 301 to 305 can be formed using an oxide semiconductor.

For example, the channel formation regions of the transistors for the switch 302 and the switch 304 are preferably formed using an oxide semiconductor. When the channel formation regions are formed using an oxide semiconductor, the off-state current of the transistors can be reduced. Consequently, the amount of charge that the capacitor 102 loses can be reduced. The channel formation regions of the transistors for the switch 303 and the switch 305 are preferably formed using silicon, particularly polycrystalline silicon or single crystal silicon. This makes it possible to increase the mobility of the transistors, thereby suppressing a voltage drop due to the generation of a current in the transistors.

The W/L ratio of the transistor for the switch 303 (W denotes channel width, and L denotes channel length) is preferably higher than that of the transistors for the switch 302, the switch 301, or the switch 304. In addition, the W/L ratio of the transistor for the switch 305 is preferably higher than that of the transistors for the switch 302, the switch 301, or the switch 304.

When the W/L ratio of the transistor for the switch 303 is high, the potential of the first terminal of the transistor 101 can be prevented from decreasing from V2 due to voltage drop in the period T3. When the W/L ratio of the transistor for the switch 305 is high, the potential of the first terminal of the transistor 101 can be prevented from increasing due to voltage drop in the period T3. When the W/L ratio of the transistor for the switch 302 and the W/L ratio of the transistor for the switch 304 are low, the off-state current of the transistors can be reduced, thereby reducing the amount of charge that the capacitor 102 loses.

The W/L ratio of the transistor for the switch 303 is preferably higher than that of the transistor for the switch 305. This is because changes in the potential of the first terminal of the transistor 101 have greater influence than those in the potential of the second terminal of the transistor 101 on current generated in the display element 103, and changes in the potential of the first terminal of the transistor 101 cause changes in Vgs.

One or both of the transistor for the switch 302 and the transistor for the switch 304 are preferably a multi-gate transistor (e.g. a transistor with a plurality of gates). Thus, the off-state current of the transistor can be reduced, thereby reducing the amount of charge that the capacitor 102 loses.

Controlling the conduction state of a switch in such a manner enables the pixel in FIG. 5 to perform an operation for initializing the pixel, an operation for applying a video signal to the pixel, and an operation for displaying an image in accordance with a video signal.

According to this embodiment, it is possible to reduce the influence of variations in Vth of the transistor 101 (drive transistor) and provide a display device capable of controlling the luminance of each pixel without being influenced by variations in Vth of the transistor 101. A fixed potential is applied to the line 212 and the line 213 used for correcting Vth. Thus, a display device in which power consumption is reduced, and the size of a circuit and the number of connection points are not increased can be provided.

This embodiment can be freely combined with any of the other embodiments.

Embodiment 5

A pixel of a display device in this embodiment will be described with reference to FIG. 10, FIG. 11, FIG. 12, FIG. 13, FIG. 14, FIG. 15, and FIG. 16.

Figure 10:
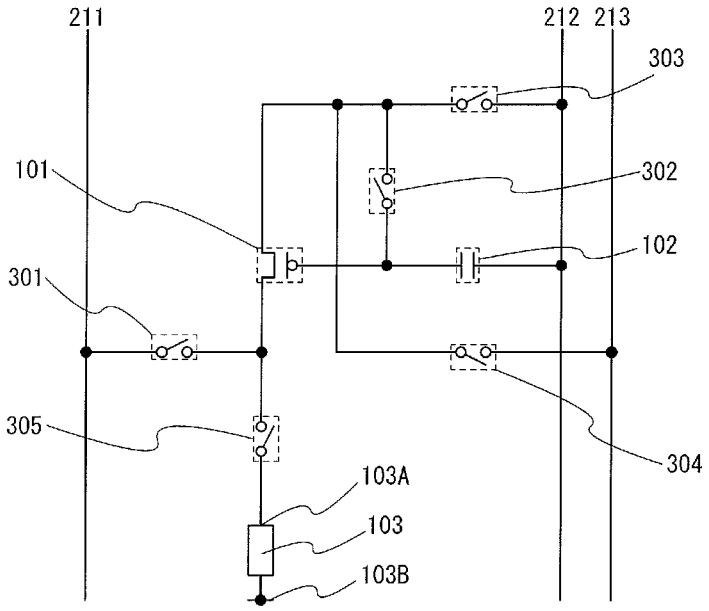
FIG. 10 is an example of a diagram showing a circuit configuration of a pixel included in a display device.

FIG. 10 shows the circuit configuration of a pixel that can perform the operations shown in FIGS. 1A to 1C. Differences between FIG. 5 and FIG. 10 will be described below. In FIG. 10, the switch 304 is connected between the first terminal of the transistor 101 and the line 213. This is a point different from FIG. 5. The pixel shown in FIG. 10 can operate in a manner similar to those shown in FIG. 6, FIG. 7, FIG. 8, and FIG. 9.

Figure 11:
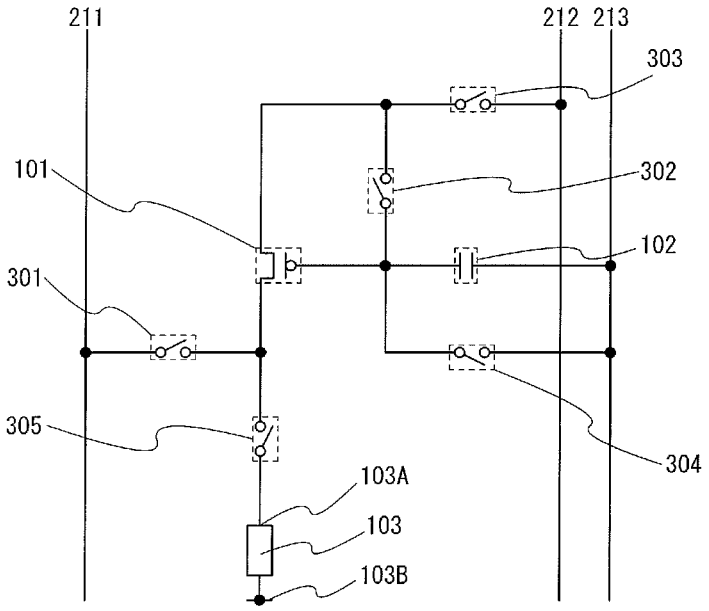
FIG. 11 is an example of a diagram showing a circuit configuration of a pixel included in a display device.

FIG. 11 shows the circuit configuration of a pixel that can perform the operations shown in FIGS. 1A to 1C. Differences between FIG. 5 and FIG. 11 will be described below. In FIG. 11, the first terminal of the capacitor 102 is connected to the line 213. This is a point different from FIG. 5. The pixel shown in FIG. 11 can operate in a manner similar to those shown in FIG. 6, FIG. 7, FIG. 8, and FIG. 9.

Figure 12:
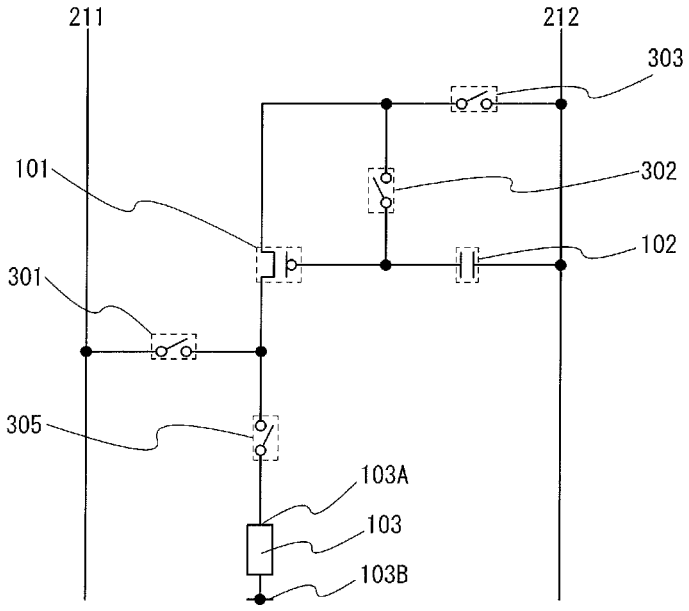
FIG. 12 is an example of a diagram showing a circuit configuration of a pixel included in a display device.

FIG. 12 shows the circuit configuration of a pixel that can perform the operation shown in FIG. 3A. Differences between FIG. 5 and FIG. 12 will be described below. In FIG. 12, the switch 304 and the line 213 are omitted. This is a point different from FIG. 5. In FIG. 12, for the operation of the pixel, the switch 303 is turned on in the period T1, and the potential of the line 212 becomes V3 in the period T1. This is a point different from FIG. 5 and FIG. 6. The above configuration achieves a reduction in the number of switches and lines.

Figure 13:
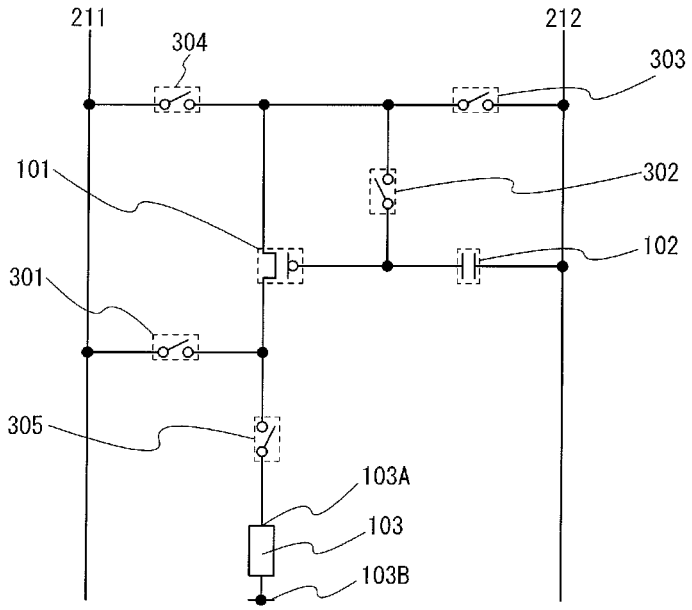
FIG. 13 is an example of a diagram showing a circuit configuration of a pixel included in a display device.

FIG. 13 shows the circuit configuration of a pixel that can perform the operation shown in FIG. 3B. Differences between FIG. 5 and FIG. 13 will be described below. In FIG. 13, the line 213 is omitted, and the switch 304 is connected between the first terminal of the transistor 101 and the line 211. This is a point different from FIG. 5. In FIG. 13, for the operation of the pixel, the potential of the line 211 becomes V3 in the period T1. This is a point different from FIG. 5 and FIG. 6. The above configuration enables a reduction in the number of lines.

Note that in FIG. 13, the switch 304 can be connected between the gate of the transistor 101 and the line 211. This configuration can also achieve the operation in FIG. 3B.

Figure 14:
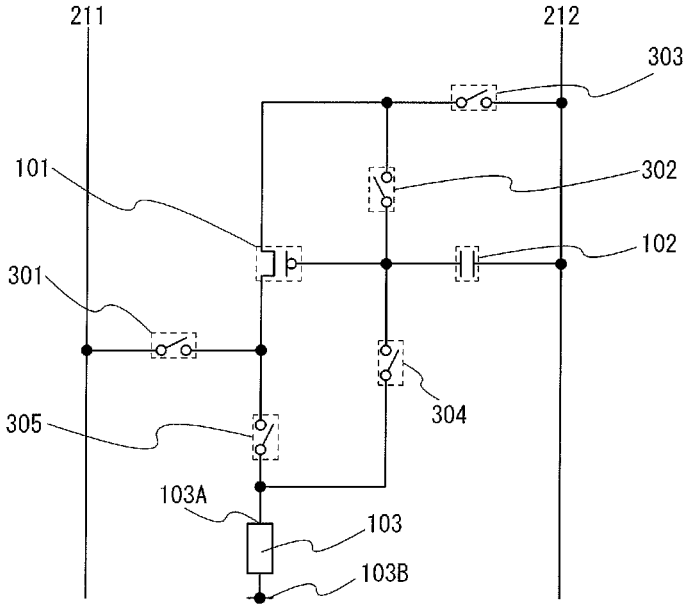
FIG. 14 is an example of a diagram showing a circuit configuration of a pixel included in a display device.

FIG. 14 shows the circuit configuration of a pixel that can perform the operation shown in FIG. 3C. Differences between FIG. 5 and FIG. 14 will be described below. In FIG. 14, the line 213 is omitted, and the switch 304 is connected between the gate of the transistor 101 and the electrode 103A. This is a point different from FIG. 5. The above configuration enables a reduction in the number of lines.

Figure 15:
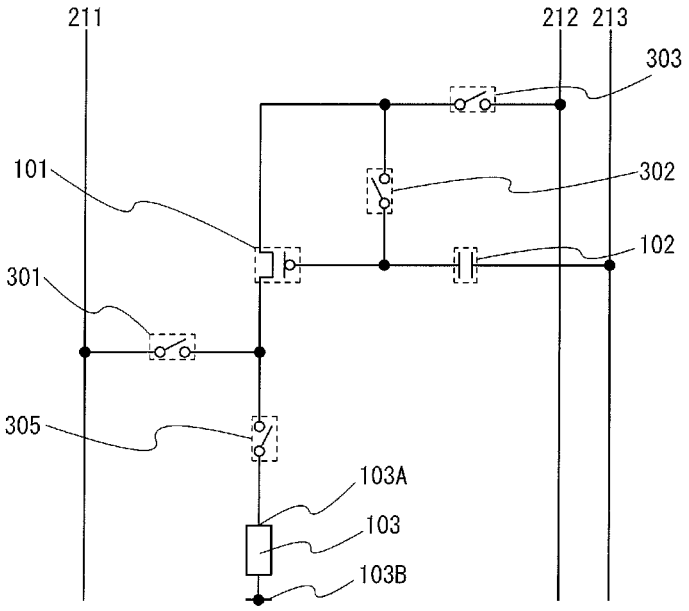
FIG. 15 is an example of a diagram showing a circuit configuration of a pixel included in a display device.

FIG. 15 shows the circuit configuration of a pixel that can perform the operation shown in FIG. 4A. Differences between FIG. 5 and FIG. 15 will be described below. In FIG. 15, the switch 304 is omitted, and the first terminal of the capacitor 102 is connected to the line 213. This is a point different from FIG. 5. In FIG. 15, for the operation of the pixel, the potential of the line 213 decreases at the timing when the period shifts from the period T3 to the period T1. This is a point different from FIG. 5 and FIG. 6.

A circuit that can perform the operation shown in FIG. 4B can employ the same circuit configuration as the pixel shown in FIG. 5. Note that for the operation of the pixel, the switch 302 is turned off in the period T1. This is a point different from FIG. 5 and FIG. 6.

Figure 16:
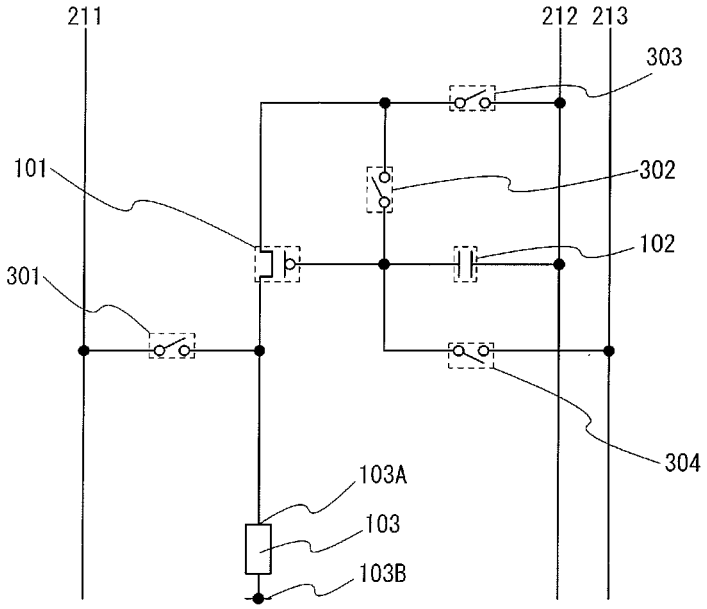
FIG. 16 is an example of a diagram showing a circuit configuration of a pixel included in a display device.

FIG. 16 shows the circuit configuration of a pixel that can perform the operations shown in FIGS. 1A to 1C. Differences between FIG. 5 and FIG. 16 will be described below. In FIG. 16, the switch 305 is omitted, and the second terminal of the transistor 101 is connected to the electrode 103A of the display element 103. This is a point different from FIG. 5. Note that in FIG. 10, FIG. 11, FIG. 12, FIG. 13, FIG. 14, and FIG. 15, the switch 305 can be omitted, and the second terminal of the transistor 101 can be connected to the electrode 103A of the display element 103.

According to this embodiment, it is possible to reduce the influence of variations in Vth of the transistor 101 (the drive transistor) and provide a display device capable of controlling the luminance of each pixel without being influenced by variations in Vth of the transistor 101. A fixed potential is applied to the line 212 and the line 213 used for correcting Vth. Thus, a display device in which power consumption is reduced, and the size of a circuit and the number of connection points are not increased can be provided.

This embodiment can be freely combined with any of the other embodiments.

Embodiment 6

A pixel included in a display device in this embodiment will be described with reference to FIG. 17, FIG. 18, FIG. 19, and FIG. 20.

Figure 17:
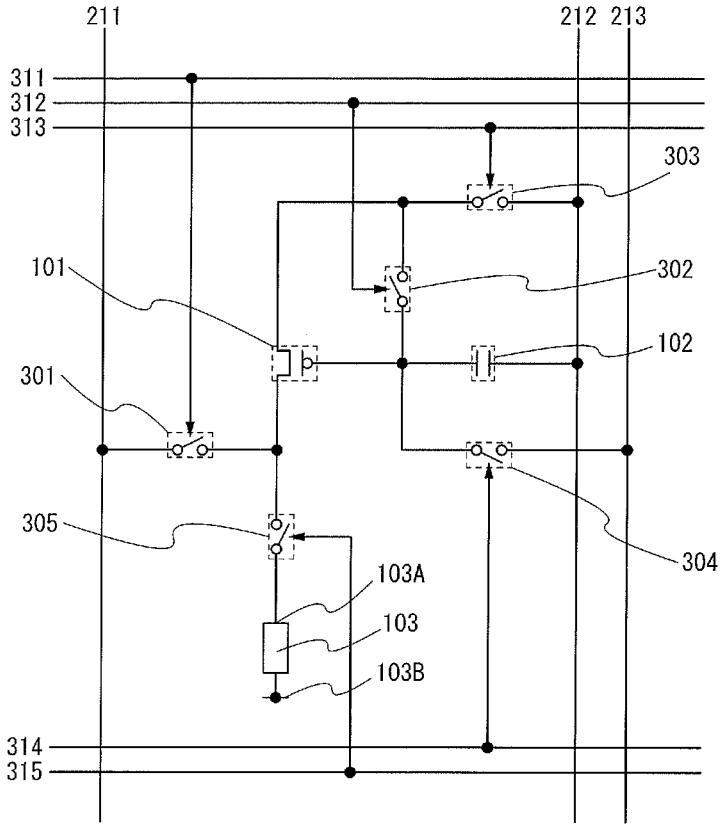
FIG. 17 is an example of a diagram showing a circuit configuration of a pixel included in a display device.

FIG. 17 shows an example of the circuit configuration of the pixel shown in FIG. 5 that is connected to lines 311 to 315. The conduction states of the switches 301 to 305 can be controlled by the potentials of the lines 311 to 315, respectively.

In the case where the pixel includes a plurality of switches, the switches are turned on and off at approximately the same timing. In the case where the timing when one or some of the switches are turned on and off is the reverse of the timing when the others are turned on and off, lines for controlling these switches can be combined into a single line. A definition for the expression "lines are combined into a single line" will be explained. For example, a line A is connected to a terminal T, and a line B is connected to a terminal U. In this case, the expression "the line A and the line B are combined into a single line" means that one of the line A and the line B is omitted and the other of the line A and the line B is connected to the terminal T and the terminal U.

Figure 18:
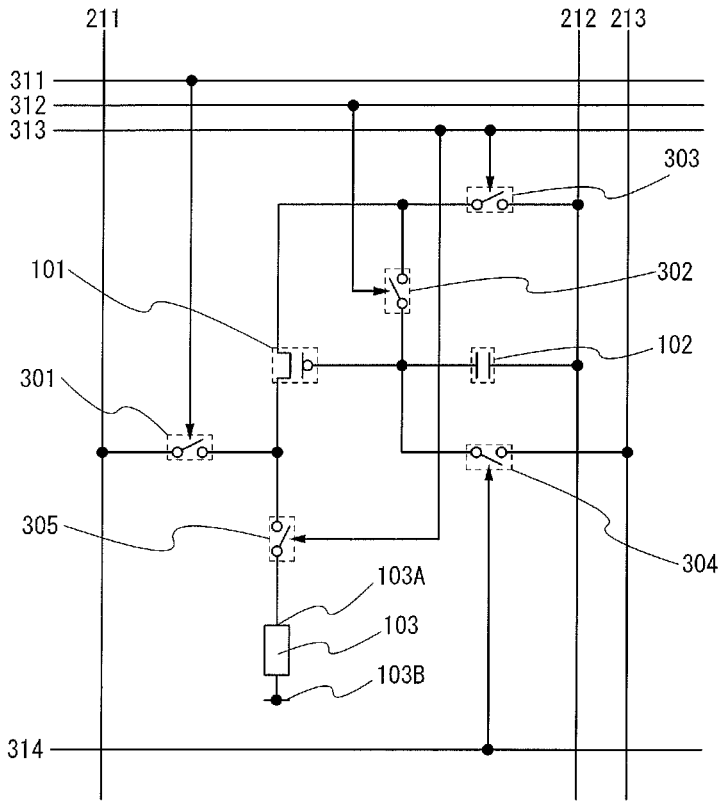
FIG. 18 is an example of a diagram showing a circuit configuration of a pixel included in a display device.

FIG. 18 shows an example of the circuit configuration of a pixel in which the line 313 and the line 315 are combined into a single line pixel. In many cases, the timing when the switch 303 is turned on and off is approximately the same as the timing when the switch 305 is turned on and off. The line 313 and the line 315 can therefore be combined into a single line. In the pixel shown in FIG. 18, the line 315 is omitted, and the conduction state of the switch 305 is controlled by the potential of the line 313. Note that it is also acceptable that the line 313 is omitted, and the conduction state of the switch 303 is controlled by the potential of the line 315.

In many cases, the timing when the switch 303 and the switch 305 are turned on and off is the reverse of the timing when the switch 302 is turned on and off. It is therefore possible to combine the line 312 and the line 313 into a single line, the line 312 and the line 315 into a single line, or the line 312, the line 313, and the line 315 into a single line. In such a case, the conductivity type of an element used as the switch 302 is preferably the reverse of that of elements used as the switch 303 and the switch 305. For example, when the switch 302 is an n-channel transistor or a PNP transistor, the switch 303 and the switch 305 are preferably p-channel transistors or NPN transistors.

Various elements (e.g. transistors, diodes, and resistors) or various circuits (e.g. CMOS switches and analog switches) can be used as the switches.

Figure 19:
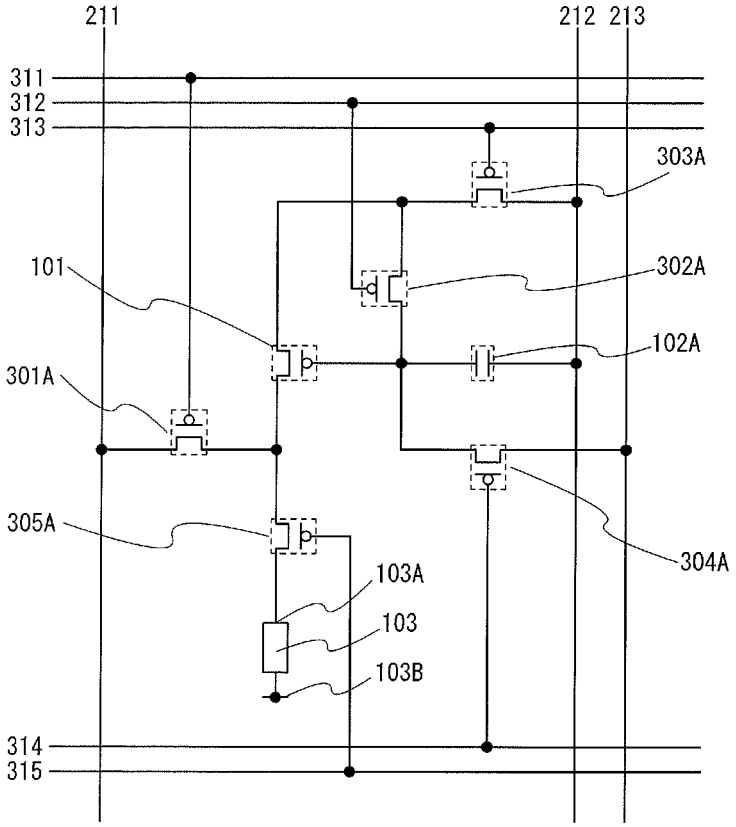
FIG. 19 is an example of a diagram showing a circuit configuration of a pixel included in a display device.

FIG. 19 shows an example of the circuit configuration of a pixel shown in FIG. 5 in which transistors are used as the switches. Transistors 301A to 305A are used as the switches 301 to 305, respectively. The transistors 301A to 305A have the same functions as the switches 301 to 305, respectively. A first terminal of the transistor 301A is connected to the line 211. A second terminal of the transistor 301A is connected to the second terminal of the transistor 101. A gate of the transistor 301A is connected to the line 311. A first terminal of the transistor 302A is connected to the first terminal of the transistor 101. A second terminal of the transistor 302A is connected to the gate of the transistor 101. A gate of the transistor 302A is connected to the line 312. A first terminal of the transistor 303A is connected to the line 212. A second terminal of the transistor 303A is connected to the first terminal of the transistor 101. A gate of the transistor 303A is connected to the line 313. A first terminal of the transistor 304A is connected to the line 213. A second terminal of the transistor 304A is connected to the gate of the transistor 101. A gate of the transistor 304A is connected to the line 314. A first terminal of the transistor 305A is connected to the second terminal of the transistor 101. A second terminal of the transistor 305A is connected to the electrode 103A of the display element 103. A gate of the transistor 305A is connected to the line 315.

The transistors 301A to 305A can be p-channel transistors. When all the transistors are of the same conductivity type, a reduction in the number of steps, a reduction in manufacturing cost, and improvement in yield can be achieved. Note that all, or one or some of the transistors 301A to 305A can be n-channel transistors.

Figure 20:
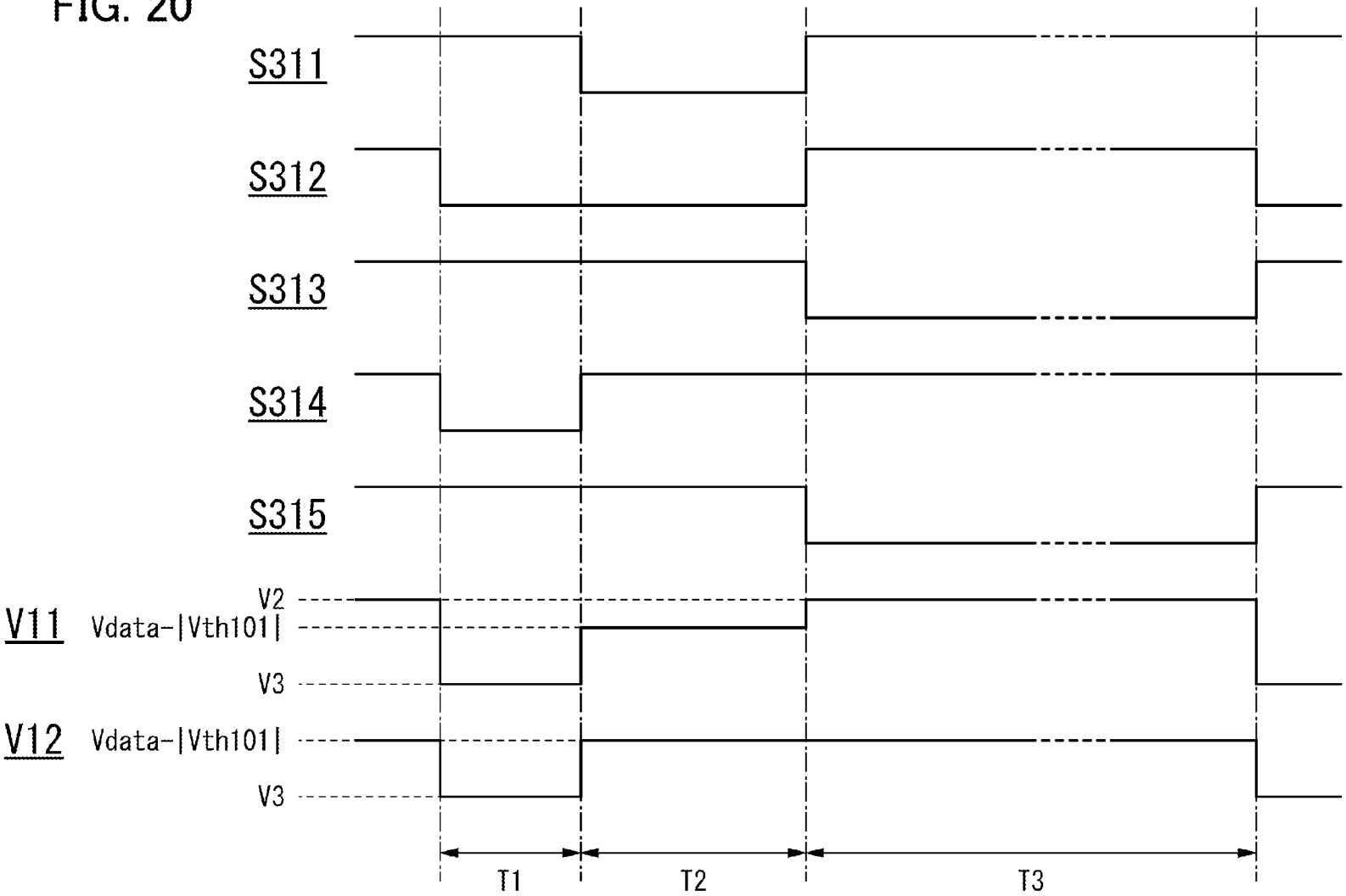
FIG. 20 is an example of a timing chart applicable to the pixel included in the display device.

An example of the operation of the pixel shown in FIG. 19 will be described with reference to FIG. 20. FIG. 20 shows an example of a timing chart applicable to the pixel shown in FIG. 19. The timing chart shown in FIG. 20 includes the period T1, the period T2, and the period T3. The timing chart shown in FIG. 20 shows potentials S311 to S315 in addition to the potential of the node 11 (V11) and the potential of the node 12 (V12). The potentials S311 to S315 are examples of the potentials of signals input to the lines 311 to 315, respectively. The lines 311 to 315 can serve as signal lines.

In the period T1, the potential S311, the potential S312, the potential S313, the potential S314, and the potential S315 are high, low, high, low, and high, respectively. In the period T2, the potentials S311, the potential S312, the potential S313, the potential S314, and the potential S315 are low, low, high, high, and high, respectively. In the period T3, the potential S311, the potential S312, the potential S313, the potential S314, and the potential S315 are high, high, low, high, and low, respectively. Thus, the pixel can operate in a manner similar to that described with reference to FIG. 5 and FIG. 6.

According to this embodiment, it is possible to reduce the influence of variations in Vth of the transistor 101 (the drive transistor) and provide a display device capable of controlling the luminance of each pixel without being influenced by variations in Vth of the transistor 101. A fixed potential is applied to the line 212 and the line 213 used for correcting Vth. Thus, a display device in which power consumption is reduced, and the size of a circuit and the number of connection points are not increased can be provided.

This embodiment can be freely combined with any of the other embodiments.

Embodiment 7

A pixel included in a display device in this embodiment will be described with reference to FIG. 21, FIG. 22, FIG. 23, FIG. 24, FIG. 25, FIG. 26, FIG. 27, FIG. 28, and FIG. 29.

Figure 21:
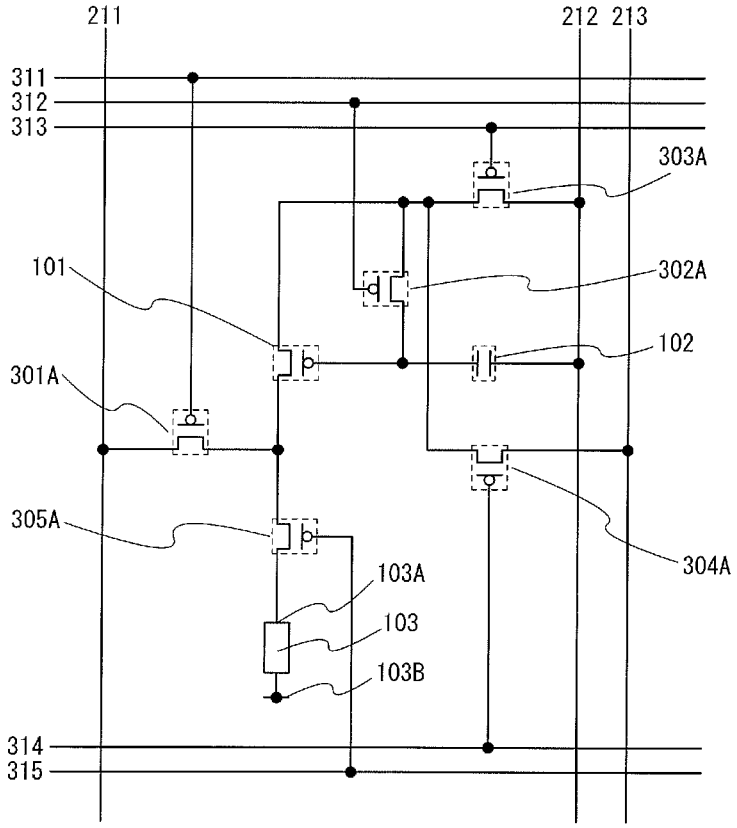
FIG. 21 is an example of a diagram showing a circuit configuration of a pixel included in a display device.

FIG. 21 shows an example of a circuit configuration same as that shown in FIG. 10 except that transistors are used as the switches. Differences between FIG. 19 and FIG. 21 will be described below. In FIG. 21, the second terminal of the transistor 304A is connected to the first terminal of the transistor 101. This is a point different from FIG. 19.

Figure 22:
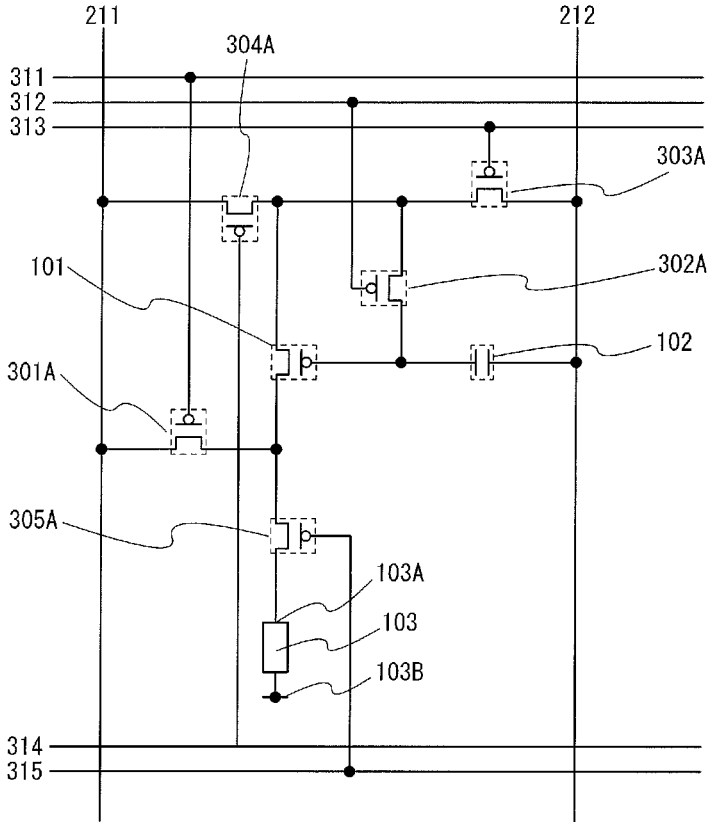
FIG. 22 is an example of a diagram showing a circuit configuration of a pixel included in a display device.

FIG. 22 shows an example of a circuit configuration same as that shown in FIG. 13 except that transistors are used as the switches. Differences between FIG. 19 and FIG. 22 will be described below. In FIG. 22, the first terminal of the transistor 304A is connected to the line 211, and the second terminal of the transistor 304A is connected to the first terminal of the transistor 101. This is a point different from FIG. 19.

Figure 23:
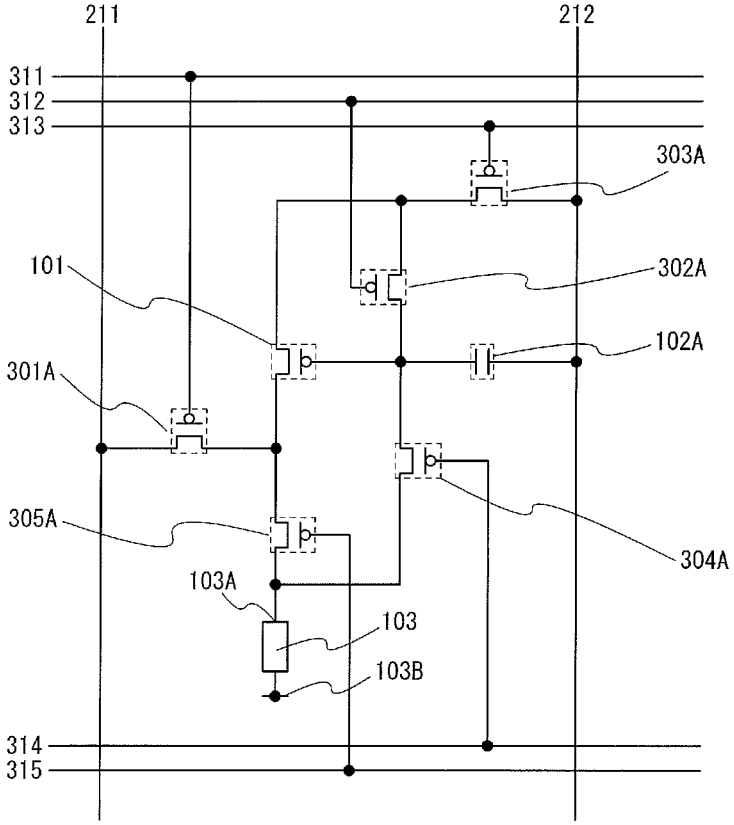
FIG. 23 is an example of a diagram showing a circuit configuration of a pixel included in a display device.

FIG. 23 shows an example of a circuit configuration same as that shown in FIG. 14 except that transistors are used as the switches. Differences between FIG. 19 and FIG. 23 will be described below. In FIG. 23, the first terminal of the transistor 304A is connected to the electrode 103A, and the line 213 is omitted. This is a point different from FIG. 19.

Figure 24:
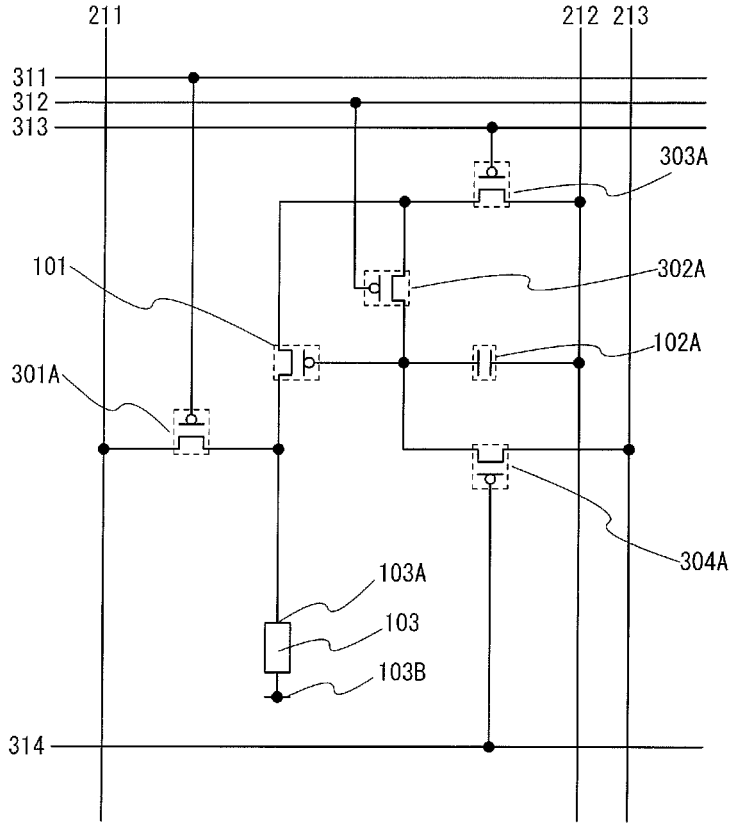
FIG. 24 is an example of a diagram showing a circuit configuration of a pixel included in a display device.

FIG. 24 shows an example of a circuit configuration same as that shown in FIG. 16 except that transistors are used as the switches. Differences between FIG. 19 and FIG. 24 will be described below. In FIG. 24, the transistor 305A and the line 315 are omitted, and the second terminal of the transistor 101 is connected to the electrode 103A. This is a point different from FIG. 19.

Although not illustrated, in the pixels shown in FIG. 12 and FIG. 15, transistors can be used as the switches.

Figure 25:
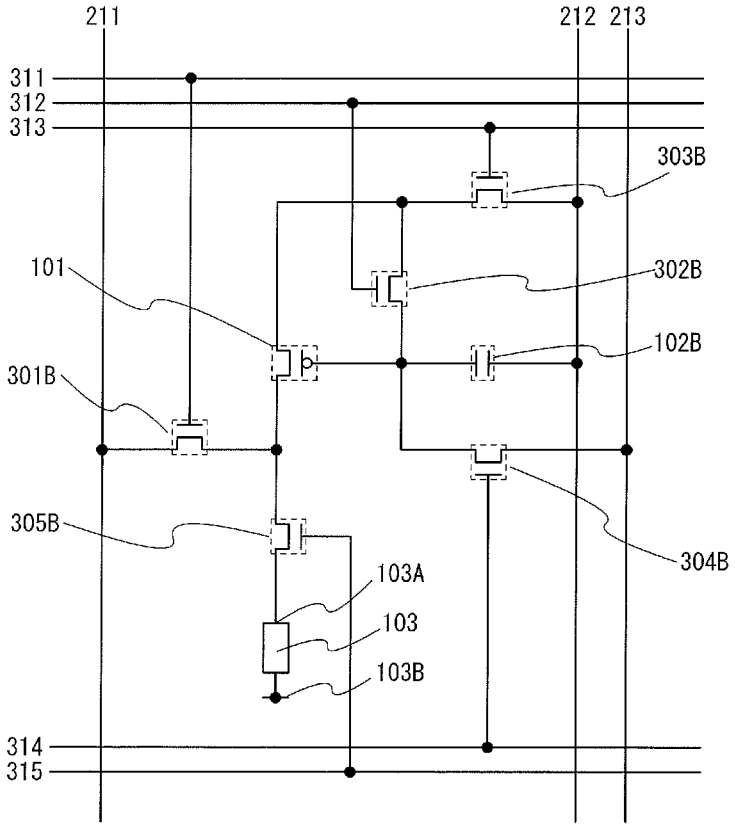
FIG. 25 is an example of a diagram showing a circuit configuration of a pixel included in a display device.

FIG. 25 shows an example of a circuit configuration same as that shown in FIG. 5 except that transistors which are n-channel transistors are used as the switches. The transistors 301B to 305B shown in FIG. 25 have the same function as the transistor 301A to 305A shown in FIG. 19. The transistors 301B to 305B shown in FIG. 25 have the same connections as the transistors 301A to 305A shown in FIG. 19. Note that all, or one or some of the transistors 301B to 305B can be p-channel transistors.

Figure 26:
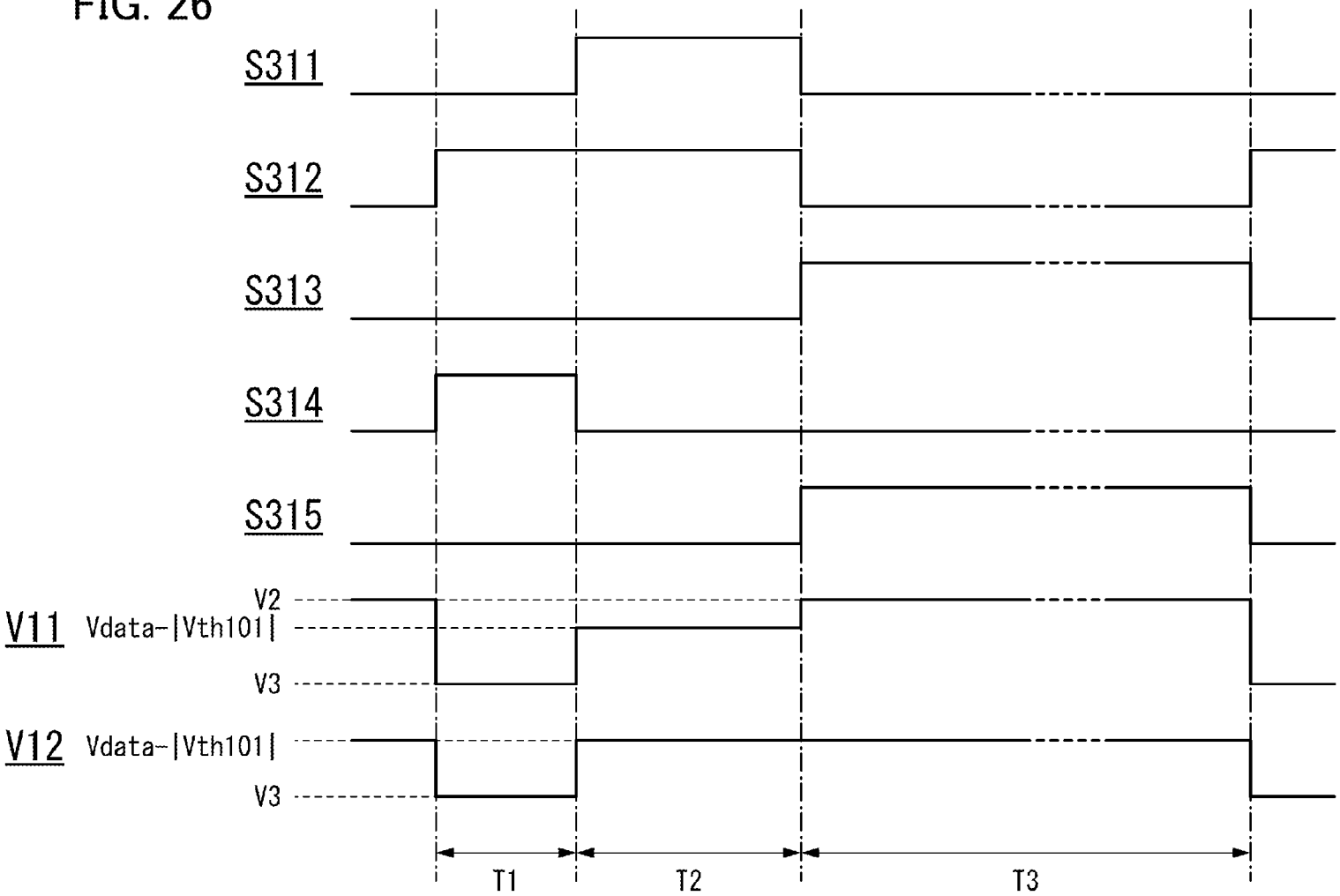
FIG. 26 is an example of a timing chart applicable to the pixel included in the display device.

An example of the operation of the pixel shown in FIG. 25 will be described with reference to FIG. 26. FIG. 26 shows an example of a timing chart applicable to the pixel shown in FIG. 25. The timing chart shown in FIG. 26 includes the period T1, the period T2, and the period T3. The timing chart shown in FIG. 26 shows the potentials S311 to S315 in addition to the potential of the node 11 (V11) and the potential of the node 12 (V12). The potentials S311 to S315 are examples of the potentials of signals input to the lines 311 to 315, respectively. The lines 311 to 315 can serve as signal lines.

In the timing chart shown in FIG. 26, the potential S311, the potential S312, the potential S313, the potential S314, and the potential S315 are obtained, in many cases, by inverting the potential S311, the potential S312, the potential S313, the potential S314, and the potential S315 shown in the timing chart in FIG. 20.

Figure 27:
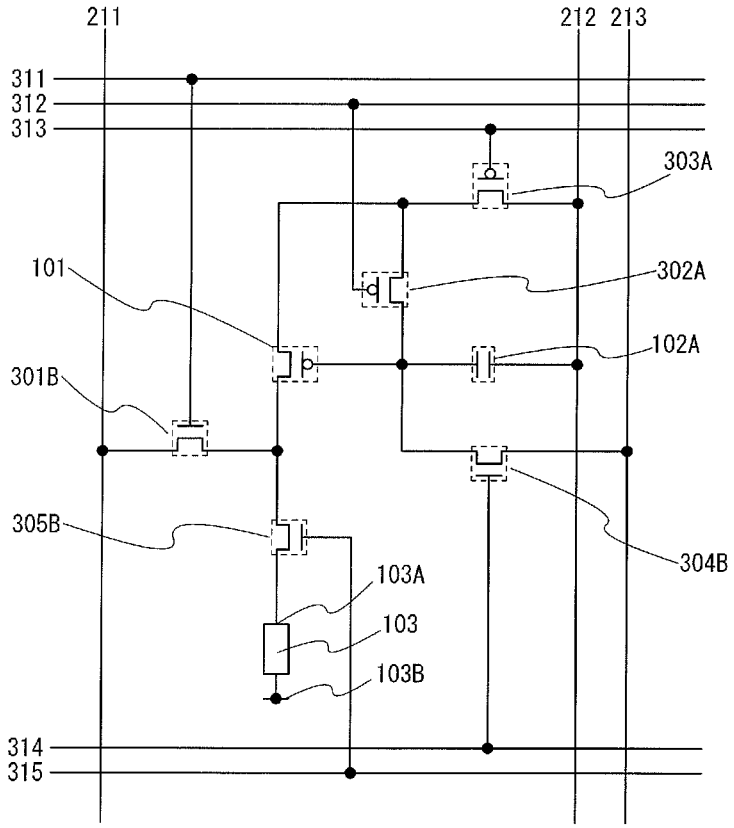
FIG. 27 is an example of a diagram showing a circuit configuration of a pixel included in a display device.

FIG. 27 shows an example of the circuit configuration same as that shown in FIG. 19 except that the transistor 301A, the transistor 304A, and the transistor 305A that are p-channel transistors are replaced with the transistor 301B, the transistor 304B, and the transistor 305B that are n-channel transistors, respectively. The transistor 303A is connected to the line 212 that is at high potential, and thus is preferably a p-channel transistor. Thus, the source of the transistor can be set at high potential, so that the absolute value of Vgs can be increased. The transistor 303A can therefore operate accurately as a switch. The transistor 304B is connected to the line 213 that is at low potential, and thus is preferably an n-channel transistor. Thus, the source of the transistor can be set at low potential, so that Vgs can be increased. The transistor 304B can therefore operate accurately as a switch.

Figure 28:
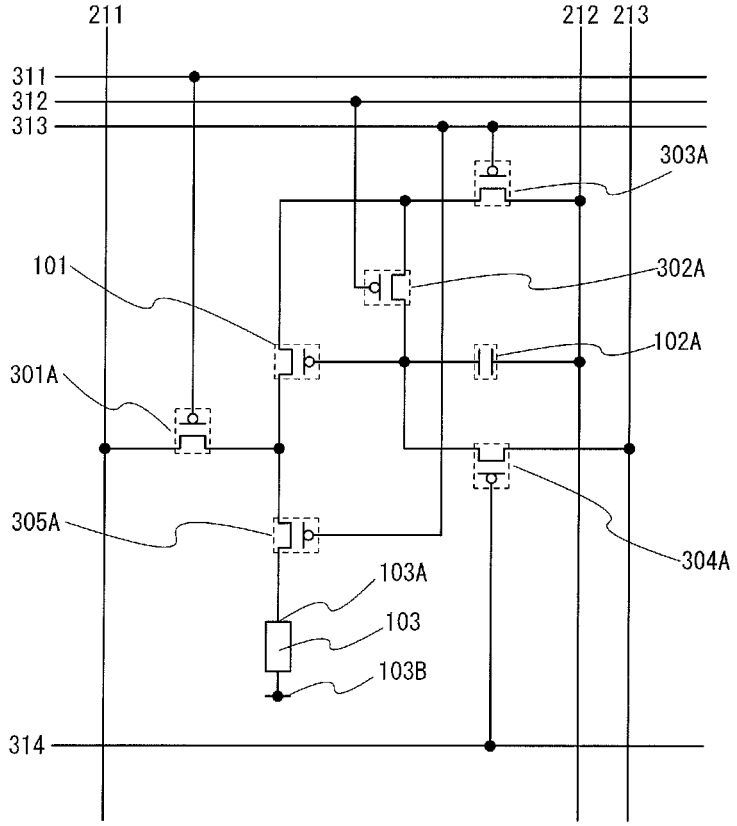
FIG. 28 is an example of a diagram showing a circuit configuration of a pixel included in a display device.

In each of the above-described pixels, the lines can be combined into a single line. FIG. 28 shows an example of the configuration same as that shown in FIG. 19 except that the line 313 and the line 315 are combined into a single line pixel. In this case, the transistor 303A and the transistor 305A can be of the same conductivity type.

Figure 29:
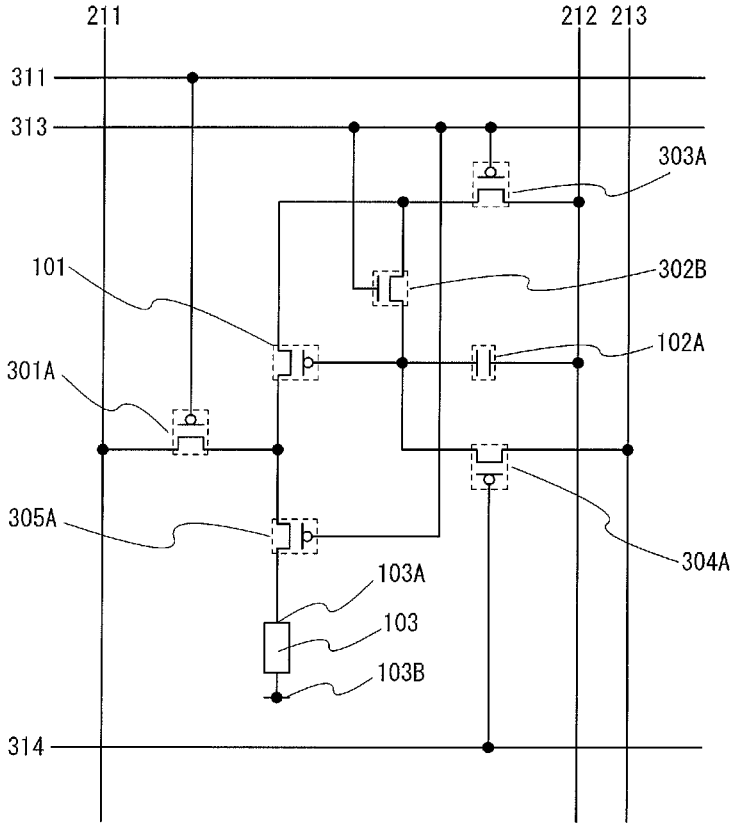
FIG. 29 is an example of a diagram showing a circuit configuration of a pixel included in a display device.

FIG. 29 shows an example of the circuit configuration same as that shown in FIG. 19 except that the line 312, the line 313, and the line 315 are combined into a single line pixel. In this case, the potential S312 of the line 312 is obtained, in many cases, by inverting potentials S313 of the line 313 and S315 of the line 315. Therefore, in FIG. 29, the conductivity type of the transistor 302B can be different from that of the transistor 303A and the transistor 305A. Specifically, in FIG. 29, the transistor 302B can be an n-channel transistor, and the transistor 303A and the transistor 305A can be p-channel transistors.

According to this embodiment, it is possible to reduce the influence of variations in Vth of the transistor 101 (the drive transistor) and provide a display device capable of controlling the luminance of each pixel without being influenced by variations in Vth of the transistor 101. A fixed potential is applied to the line 212 and the line 213 used for correcting Vth. Thus, a display device in which power consumption is reduced, and the size of a circuit and the number of connection points are not increased can be provided.

This embodiment can be freely combined with any of the other embodiments.

Embodiment 8

Figure 30:
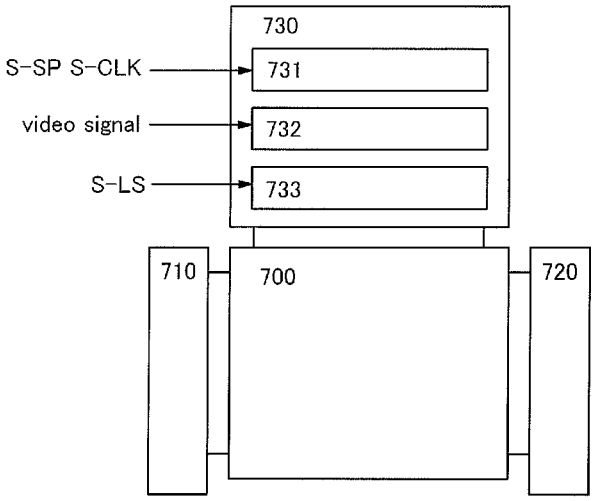
FIG. 30 is an example of a block diagram of a display device.

In this embodiment, an example of a general structure of a display device that is one embodiment of the present invention will be described with reference to FIG. 30. FIG. 30 is an example of a block diagram of a display device.

The display device shown in FIG. 30 includes: a pixel area 700 having a plurality of pixels provided with light-emitting elements; a scan line driver circuit 710 for controlling the operation of a switching element included in each pixel by controlling the potential of a first scan line; a scan line driver circuit 720 for controlling the switching of a third transistor included in each pixel by controlling the potential of a second scan line; and a signal line driver circuit 730 for controlling the input of video signals to the pixels.

In FIG. 30, the signal line driver circuit 730 includes a shift register 731, a first memory circuit 732, and a second memory circuit 733. A clock signal S-CLK and a start pulse signal S-SP are input to the shift register 731. The shift register 731 generates timing signals, pulses of which are sequentially shifted, in response to the clock signal S-CLK and the start pulse signal S-SP, and outputs the timing signals to the first memory circuit 732. The order of the appearance of the pulses of the timing signal may be switched in response to scan direction switching signals.

When a timing signal is input to the first memory circuit 732, video signals are sequentially applied to and held in the first memory circuit 732 in response to the pulse of the timing signal. Note that the video signals may be sequentially applied to a plurality of memory elements included in the first memory circuit 732. Further, so-called division driving may be performed, in which the memory elements included in the first memory circuit 732 are divided into several groups and video signals are input to each group in parallel. Note that the number of groups in this case is referred to as the number of divisions. For example, when the memory elements are divided into groups each having four memory elements, division driving is performed with four divisions.

The time until the completion of application of video signals to all of the memory elements in the first memory circuit 732 is referred to as a line period. In practice, a period when a horizontal retrace interval is added to the line period refers to a line period in some cases.

When one line period is finished, the video signals held in the first memory circuit 732 are applied to the second memory circuit 733 all at once and held in response to the pulse of a signal S-LS which is input to the second memory circuit 733. Video signals in the next line period are sequentially applied to the first memory circuit 732 which has finished sending the video signals to the second memory circuit 733, in response to timing signals from the shift register 731 again. During this second round of one line period, the video signals that are applied to and held in the second memory circuit 733 are input to the respective pixels in the pixel area 700 through signal lines.

Note that in the signal line driver circuit 730, a circuit that can output signals, pulses of which are sequentially shifted, may be used instead of the shift register 731.

Note that although the pixel area 700 is directly connected to the second memory circuit 733 in the next stage in FIG. 30, one mode illustrated in this specification is not limited to this structure. A circuit that performs signal processing on the video signals output from the second memory circuit 733 can be provided in the previous stage of the pixel area 700. Examples of a circuit that performs signal processing are a buffer which can shape a waveform, and the like.

Next, the structure of the scan line driver circuit 710 and the scan line driver circuit 720 is described. Each of the scan line driver circuit 710 and the scan line driver circuit 720 includes circuits such as a shift register, a level shifter, and a buffer.

Note that in the display device shown in FIG. 30, an example is shown in which the scan line driver circuit 710 generates signals that are input to the first scan line and the scan line driver circuit 720 generates signals that are input to the second scan line; however, one scan line driver circuit may generate both signals that are input to the first scan line and signals that are input to the second scan line. In addition, for example, there is a possibility that a plurality of the first scan lines used for controlling the operation of the switching element be provided in each pixel depending on the number of transistors included in the switching element and the polarity of each transistor included in the switching element. In that case, one scan line driver circuit may generate all signals that are input to the plurality of first scan lines; or a plurality of signal lines may generate all signals that are input to the plurality of first scan lines, as shown in the scan line driver circuit 710 and the scan line driver circuit 720 shown in FIG. 30.

Note that although the pixel area 700, the scan line driver circuit 710, the scan line driver circuit 720, and the signal line driver circuit 730 can be provided over the same substrate, any of them can be provided over a different substrate.

This embodiment can be implemented in combination as appropriate with any of the above-described embodiments.

Embodiment 9

An example of a fabrication method of a display device that is one embodiment of the present invention will be described. Note that although a thin film transistor (TFT) is shown as an example of a semiconductor element in this embodiment, a semiconductor element used for the display device that is one embodiment of the present invention is not limited to this. For example, a memory element, a diode, a resistor, a capacitor, an inductor, or the like can be used instead of a transistor.

Figures 31A, 31B, 31C:
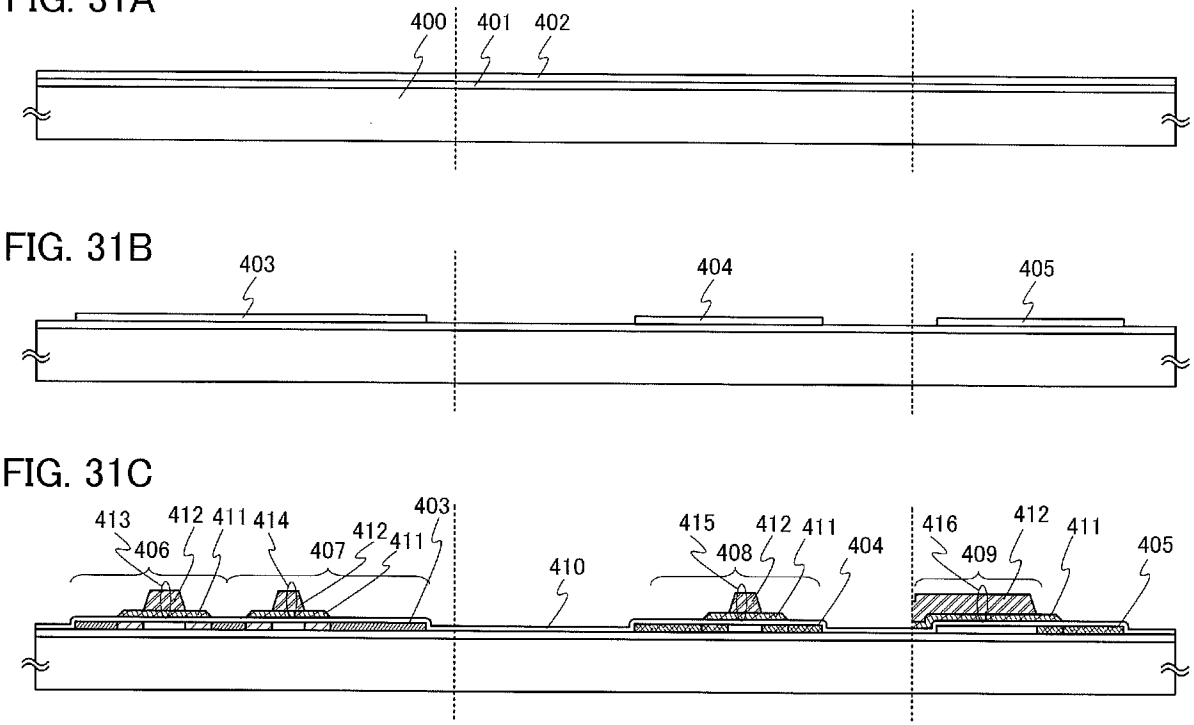
FIGS. 31A to 31C are diagrams showing an example of a fabrication method of a display device.

First, as shown in FIG. 31A, an insulating film 401 and a semiconductor film 402 are sequentially formed over a substrate 400. It is possible to form the insulating film 401 and the semiconductor film 402 successively.

A glass substrate such as a barium borosilicate glass substrate or an aluminoborosilicate glass substrate, a quartz substrate, a ceramic substrate, or the like can be used as the substrate 400. Alternatively, a metal substrate such as a stainless steel substrate with the surface provided with an insulating film, or a silicon substrate with the surface provided with an insulating film may be used. There is a tendency that a flexible substrate formed using a synthetic resin such as plastics generally has a lower allowable temperature limit than the above substrates; however, such a substrate can be used as long as it can withstand processing temperature in fabrication steps.

The insulating film 401 is provided in order that alkaline earth metal or alkali metal such as Na contained in the substrate 400 may be prevented from being diffused into the semiconductor film 402 and adversely affecting the characteristics of a semiconductor element such as a transistor. Thus, the insulating film 401 is formed using silicon oxide, silicon nitride, silicon nitride oxide, or the like which can suppress diffusion of alkali metal or alkaline earth metal into the semiconductor film 402. Note that in the case of using a substrate containing even a small amount of alkali metal or alkaline earth metal, such as a glass substrate, a stainless steel substrate, or a plastic substrate, it is effective to provide the insulating film 401 between the substrate 400 and the semiconductor film 402 from the viewpoint of preventing diffusion of impurities. However, when a substrate in which diffusion of impurities does not lead to a significant problem, such as a quartz substrate, is used as the substrate 400, the insulating film 401 is not necessarily provided.

The insulating film 401 is formed using an insulating material such as silicon oxide, silicon nitride (e.g., $SiN_x$ or $Si_3N_4$), silicon oxynitride ($SiO_xN_y$) (x>y>0), or silicon nitride oxide ($SiN_xO_y$) (x>y>0) by CVD, sputtering, or the like.

The semiconductor film 402 is preferably formed without being exposed to the air after forming the insulating film 401. The thickness of the semiconductor film 402 is 20 nm to 200 nm (preferably 40 nm to 170 nm, more preferably 50 nm to 150 nm). Note that the semiconductor film 402 may be formed using either an amorphous semiconductor or a polycrystalline semiconductor. In addition, as the semiconductor, silicon germanium, an oxide semiconductor, or the like can be used as well as silicon.

Note that the semiconductor film 402 may be crystallized by a laser crystallization method with laser light and a crystallization method with a catalytic element. Alternatively, a crystallization method with a catalytic element and a laser crystallization method can be used in combination. In addition, in the case where a substrate having high heat resistance, such as a quartz substrate, is used as the substrate 400, it is acceptable to use a combination of any of the following methods: a thermal crystallization method with an electrically heated oven, a lamp annealing crystallization method with infrared light, a crystallization method with a catalytic element, and high temperature annealing at about 950° C.

The semiconductor film 402 may remain as an amorphous semiconductor film or a microcrystalline semiconductor film without being crystallized and may be subjected to a process described below. A transistor formed using an amorphous semiconductor or a microcrystalline semiconductor has advantages of low cost and high yield because the number of fabrication steps is smaller than that of a transistor using a polycrystalline semiconductor.

Next, channel doping by which an impurity element that imparts p-type conductivity or an impurity element that imparts n-type conductivity is added at a low concentration is performed on the semiconductor film 402. The channel doping may be performed on the whole semiconductor film 402 or may be selectively performed on part of the semiconductor film 402. As an impurity element which imparts p-type conductivity, boron (B), aluminum (Al), gallium (Ga), or the like can be used. As an impurity element which imparts n-type conductivity, phosphorus (P), arsenic (As), or the like can be used. Here, boron (B) is used as the impurity element and is added so that it may be contained at a concentration of $1\times10^{16}/cm^3$ to $5\times10^{17}/cm^3$.

Next, as shown in FIG. 31B, the semiconductor film 402 is processed (patterned) into a desired shape to form a semiconductor film 403, a semiconductor film 404, and a semiconductor film 405 which have island shapes.

Then, as shown in FIG. 31C, a transistor 406, a transistor 407, a transistor 408, and a storage capacitor (also referred to as a capacitor) 409 are formed using the semiconductor film 403, the semiconductor film 404, and the semiconductor film 405.

Specifically, a gate insulating film 410 is formed so as to cover the semiconductor film 403, the semiconductor film 404, and the semiconductor film 405. Then, over the gate insulating film 410, a plurality of conductive films 411 and 412 which are processed (patterned) into desired shapes are formed. A pair of the conductive films 411 and a pair of the conductive films 412 which overlap with the semiconductor film 403 function as a gate electrode 413 of the transistor 406 and a gate electrode 414 of the transistor 407. The conductive films 411 and 412 which overlap with the semiconductor film 404 function as a gate electrode 415 of the transistor 408. Further, the conductive films 411 and 412 which overlap with the semiconductor film 405 function as an electrode 416 of the storage capacitor 409.

Then, impurities which impart n-type or p-type conductivity are added to the semiconductor film 403, the semiconductor film 404, and the semiconductor film 405 by using the conductive films 411, the conductive films 412, or a resist which is deposited and patterned, as a mask, so that source regions, drain regions, and LDD regions, and the like are formed. Note that here, the transistors 406 and 407 are n-channel transistors and the transistor 408 is a p-channel transistor.

Note that the gate insulating film 410 is, for example, a single layer or a stack of silicon oxide, silicon nitride, silicon nitride oxide, silicon oxynitride, or the like. In the case of using the stack, a three-layer structure in which a silicon oxide film, a silicon nitride film, and a silicon oxide film are stacked in this order from the substrate 400 side is preferably used, for example. Further, the formation method can be plasma enhanced CVD, sputtering, or the like. For example, in the case where the gate insulating film is formed using silicon oxide by plasma enhanced CVD, a mixed gas of TEOS (tetraethyl orthosilicate) and $O_2$ is used; reaction pressure is 40 Pa; substrate temperatures are 300° C. to 400° C.; and high-frequency (13.56 MHz) power densities are 0.5 $W/cm^2$ to 0.8 $W/cm^2$.

The gate insulating film 410 may be formed by oxidizing or nitriding surfaces of the semiconductor film 403, the semiconductor film 404, and the semiconductor film 405 by high-density plasma treatment. The high-density plasma treatment is performed by using, for example, a mixed gas of a rare gas such as He, Ar, Kr, or Xe, and oxygen, nitrogen oxide, ammonia, nitrogen, or hydrogen. In this case, by exciting plasma by introduction of microwaves, plasma with a low electron temperature and high density can be generated. The surfaces of the semiconductor film 403, the semiconductor film 404, and the semiconductor film 405 are oxidized or nitrided by oxygen radicals (OH radicals are included in some cases) or nitrogen radicals (NH radicals are included in some cases) generated by such high-density plasma, so that an insulating film having a thickness of 1 nm to 20 nm, typically 5 nm to 10 nm is formed so as to be in contact with the semiconductor film 403, the semiconductor film 404, and the semiconductor film 405. The insulating film having a thickness of 5 nm to 10 nm is used as the gate insulating film 410.

In addition, although the gate electrode 413, the gate electrode 414, the gate electrode 415, and the electrode 416 are formed using the stacked two conductive films 411 and 412 in this embodiment, one embodiment in this specification is not limited to this structure. Instead of the conductive films 411 and 412, a single-layer conductive film or a multilayer conductive film in which three or more layers are stacked may be used. In the case of using a three-layer structure in which three or more conductive films are stacked, a stack of a molybdenum film, an aluminum film, and a molybdenum film may be used.

For the conductive film for forming the gate electrode 413, the gate electrode 414, the gate electrode 415, the electrode 416, tantalum (Ta), tungsten (W), titanium (Ti), molybdenum (Mo), aluminum (Al), copper (Cu), chromium (Cr), niobium (Nb), or the like can be used. Alternatively, an alloy whose main component is any of the above metals or a compound containing any of the above metals can be used. Alternatively, the conductive film may be formed using a semiconductor such as polycrystalline silicon, in which a semiconductor film is doped with an impurity element which imparts conductivity, such as phosphorus.

In this embodiment, a tantalum nitride film or a tantalum (Ta) film is used for the conductive film 411, which is a first layer, and a tungsten (W) film is used for the conductive film 412, which is a second layer. As well as the example described in this embodiment, the following combination of two conductive films can be used: a tungsten nitride film and a tungsten film; a molybdenum nitride film and a molybdenum film; all aluminum film and a tantalum film; an aluminum film and a titanium film; and the like. Since tungsten and tantalum nitride have high heat resistance, heat treatment for thermal activation can be performed in a step after forming the two-layer conductive films. Alternatively, as the combination of the two-layer conductive films, a silicon film doped with an impurity which imparts n-type conductivity and a nickel silicide film, a Si film doped with an impurity which imparts n-type conductivity and a $WSi_x$ film, or the like can be used.

CVD, sputtering, or the like can be used for forming the conductive films 411 and 412. In this embodiment, the conductive film 411, which is the first layer, is formed to a thickness of 20 nm to 100 nm and the conductive film 412, which is the second layer, is formed to a thickness of 100 nm to 400 nm.

Note that when the gate electrode 413, the gate electrode 414, the gate electrode 415, and the electrode 416 are formed, an optimal etching method and an optimal etchant may be selected as appropriate in accordance with materials used for the conductive films. Here, the conductive film 411 using tantalum nitride and the conductive film 412 using tungsten, which has smaller width than the conductive film 411 are formed by etching.

In addition, by using the conductive film 411 and the conductive film 412 formed through the first etching and the second etching as masks, impurity regions which function as the source regions, the drain regions, and the LDD regions can be separately formed in the semiconductor film 403, the semiconductor film 404, the semiconductor film 405, and the semiconductor film 450, without forming a mask additionally.

After the impurity regions are formed, the impurity regions may be activated by heat treatment. For example, after a 50-nm-thick silicon oxynitride film is formed, heat treatment may be performed at 550° C. for 4 hours in a nitrogen atmosphere.

Alternatively, after a silicon nitride film containing hydrogen is formed to a thickness of 100 nm, heat treatment may be performed at 410° C. for 1 hour in a nitrogen atmosphere so that the semiconductor film 403, the semiconductor film 404, and the semiconductor film 405 are hydrogenated. Alternatively, the semiconductor film 403, the semiconductor film 404, and the semiconductor film 405 may be hydrogenated in the following manner. Heat treatment is performed at 400° C. to 700° C. (preferably 500° C. to 600° C.) in a nitrogen atmosphere at an oxygen concentration of 1 ppm or less, preferably 0.1 ppm or less; and then, heat treatment is performed at 300° C. to 450° C. for 1 to 12 hours in an atmosphere containing hydrogen at 3 to 100%. This step enables dangling bonds to be terminated by thermally excited hydrogen. As a different hydrogenation method, plasma hydrogenation (using hydrogen excited by plasma) may be performed. Alternatively, activation treatment may be performed after an insulating film 417 which is to be formed later is formed.

For the heat treatment, a thermal annealing method using an annealing furnace, a laser annealing method, a rapid thermal annealing method (an RTA method), or the like can be used. By the heat treatment, not only hydrogenation but also activation of impurity elements which are added to the semiconductor film 403, the semiconductor film 404, and the semiconductor film 405 can be performed.

The above series of steps enable the formation of the n-channel transistors 406 and 407, the p-channel transistor 408, and the storage capacitor 409. Note that a fabrication method of the transistors is not limited to the above process.

Figure 32A:
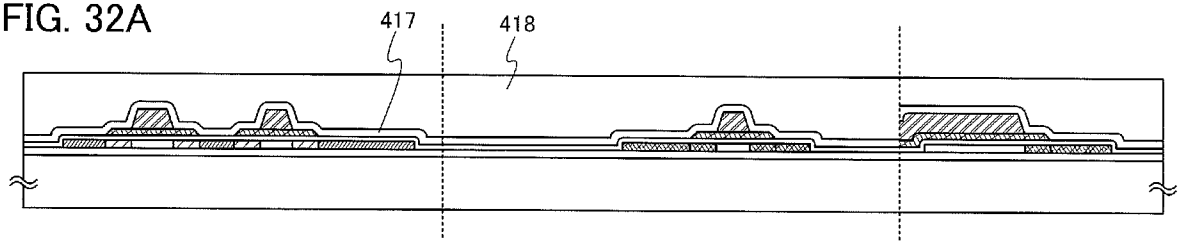
FIGS. 32A and 32B are diagrams showing an example of a fabrication method of the display device.

Next, the insulating film 417 is formed so as to cover the transistor 406, the transistor 407, the transistor 408, and the storage capacitor 409 as shown in FIG. 32A. Although the insulating film 417 is not necessarily provided, by providing the insulating film 417, impurities such as an alkali metal or an alkaline earth metal can be prevented from entering the transistor 406, the transistor 407, the transistor 408, and the storage capacitor 409. Specifically, it is preferable to use silicon nitride, silicon nitride oxide, aluminum nitride, aluminum oxide, silicon oxide, silicon oxynitride, or the like for the insulating film 417. In this embodiment, a silicon oxynitride film having a thickness of about 600 nm is used for the insulating film 417. In this case, the above hydrogenation step may be performed after the silicon oxynitride film is formed.

Next, an insulating film 418 is formed over the insulating film 417 so as to cover the transistor 406, the transistor 407, the transistor 408, and the storage capacitor 409. An organic material having heat resistance, such as acrylic, polyimide, benzocyclobutene, polyamide, or epoxy, can be used for the insulating film 418. As well as the above organic material, a low dielectric constant material (a low-k material), a siloxane-based resin, silicon oxide, silicon nitride, silicon oxynitride, silicon nitride oxide, PSG (phosphosilicate glass), BPSG (borophosphosilicate glass), alumina, or the like can be used. A siloxane-based refers to a material in which a skeletal structure is formed by the bond of silicon (Si) and oxygen (O). A siloxane-based resin may have at least one kind of fluorine, a fluoro group, and an organic group (e.g., an alkyl group or an aromatic hydrocarbon group) as well as hydrogen, as a substituent. Note that the insulating film 418 may be formed by stacking a plurality of insulating films formed using such materials.

The insulating film 418 can be formed by CVD, sputtering, SOG, spin coating, dipping, spray coating, a droplet discharge method (e.g., an inkjet method, screen printing, or offset printing), a doctor knife, a roll coater, a curtain coater, a knife coater, or the like, depending on the material of the insulating film 418.

In this embodiment, the insulating film 417 and the insulating film 418 function as an interlayer insulating film; however, a single-layer insulating film may be used as the interlayer insulating film, or a stacked-layer insulating film having three or more layers may be used as the interlayer insulating film.

Figure 32B:
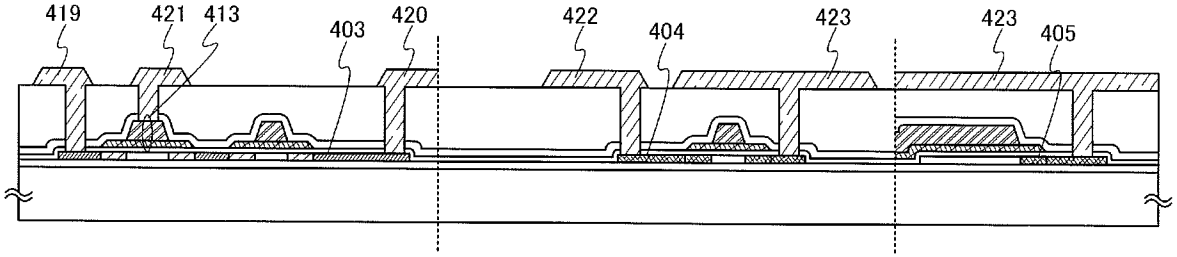

Next, as shown in FIG. 32B, contact holes are formed in the insulating film 417 and the insulating film 418 so that the semiconductor film 403, the semiconductor film 404, the semiconductor film 405, and the gate electrode 413 are partly exposed. As an etching gas for opening the contact holes, a mixed gas of $CHF_3$ and He is used; however, the etching gas is not limited to this. Further, conductive films 419 and 420 which are in contact with the semiconductor film 403 through the contact holes, a conductive film 421 which is in contact with the gate electrode 413 through the contact hole, a conductive film 422 which is in contact with the semiconductor film 404 through the contact hole, and conductive films 423 which are in contact with the semiconductor film 404 and the semiconductor film 405 through the contact holes are formed.

The conductive films 419 to 423 can be formed by CVD, sputtering, or the like. Specifically, for the conductive films 419 to 423, aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), silicon (Si), or the like can be used. Alternatively, an alloy whose main component is any of the above elements or a compound containing any of the above elements can be used. As the conductive films 419 to 423, a single-layer film of any of the above elements or a plurality of stacked films of any of the above elements can be used.

Examples of an alloy whose main component is aluminum include an alloy that contains aluminum as its main component and nickel, and an alloy that contains aluminum as its main component, nickel, and one or both of carbon and silicon. Since aluminum and aluminum silicon have low resistance values and are inexpensive, aluminum and aluminum silicon are suitable for materials used for the conductive films 419 to 423. In particular, aluminum silicon can prevent, more effectively than an aluminum film, formation of hillocks in resist baking performed when the conductive films 419 to 423 are patterned. Further, instead of silicon (Si), Cu may be mixed into the aluminum film at about 0.5%.

In this embodiment, a titanium film, an aluminum film, and a titanium film are stacked in that order from the insulating film 418 side. Then, these stacked films are patterned to form the conductive films 419 to 423.

Figure 33A:
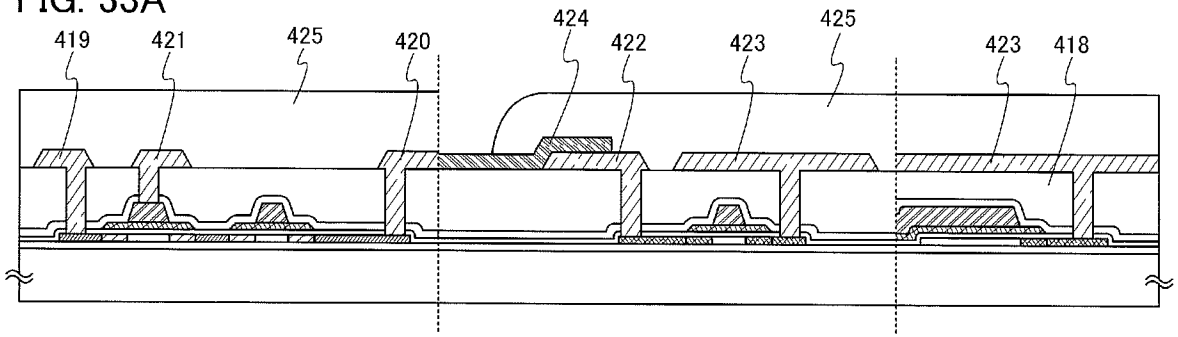
FIGS. 33A and 33B are diagrams showing an example of a fabrication method of the display device.

Next, as shown in FIG. 33A, a pixel electrode 424 is formed so as to be in contact with the conductive film 422.

In this embodiment, after a light-transmitting conductive film is formed using indium tin oxide containing silicon oxide (ITSO) by sputtering, the conductive film is patterned to form the pixel electrode 424. Note that a light-transmitting oxide conductive material other than ITSO, such as indium tin oxide (ITO), zinc oxide (ZnO), indium oxide zinc (IZO), or zinc oxide to which gallium is added (GZO), may be used for the pixel electrode 424. Alternatively, for the pixel electrode 424, as well as the light-transmitting oxide conductive material, a single-layer film containing one or more of titanium nitride, zirconium nitride, Ti, W, Ni, Pt, Cr, Ag, Al, and the like, a stack of a titanium nitride and a film whose main component is aluminum, a three-layer structure of a titanium nitride film, a film whose main component is aluminum, and a titanium nitride film, or the like can be used, for example. Note that in the case where light is extracted from the pixel electrode 424 side by using a material other than the light-transmitting oxide conductive material, the pixel electrode 424 is formed to such a thickness that light can transmit therethrough (preferably about 5 nm to 30 nm).

In the case of using ITSO for the pixel electrode 424, a target in which silicon oxide is contained in ITO at 2 to 10 weight percent can be used. Specifically, in this embodiment, by using a target containing $In_2O_3$, $SnO_2$, and $SiO_2$ at a weight percent ratio of 85:10:5, a conductive film which serves as the pixel electrode 424 is formed to a thickness of 105 nm, with a flow rate of Ar at 50 sccm, a flow rate of $O_2$ at 3 sccm, a sputtering pressure of 0.4 Pa, a sputtering power of 1 kW, and a deposition rate of 30 nm/min.

After the conductive film which serves as the pixel electrode 424 is formed, the surface thereof may be cleaned or polished, for example, by CMP or by cleaning with a polyvinyl alcohol-based porous body so that the surface thereof may be flattened.

Next, as shown in FIG. 33A, a partition 425 having an opening portion is formed over the insulating film 418 so as to cover part of the pixel electrode 424, and the conductive films 419 to 423. Part of the pixel electrode 424 is exposed in the opening portion of the partition 425. The partition 425 can be formed using an organic resin film, an inorganic insulating film, or a siloxane-based insulating film. In the case of using an organic resin film, acrylic, polyimide, or polyamide can be used, for example. In the case of using an inorganic insulating film, silicon oxide, silicon nitride oxide, or the like can be used. In particular, by using a photosensitive organic resin film for the partition 425 and forming an opening portion over the pixel electrode 424 so that the side wall of the opening portion may have an inclined surface of continuous curvature, the pixel electrode 424 and a common electrode 427 which is to be formed later can be prevented from being connected to each other. In this case, a mask can be formed by a droplet discharge method or a printing method. Further, the partition 425 itself can be formed by a droplet discharge method or a printing method.

Next, before an electroluminescent layer 426 is formed, heat treatment under an air atmosphere or heat treatment (vacuum baking) under a vacuum atmosphere may be performed in order to remove moisture, oxygen, or the like adsorbed in the partition 425 and the pixel electrode 424. Specifically, heat treatment is performed at a substrate temperature of 200° C. to 450° C., preferably 250° C. to 300° C. for about 0.5 to 20 hours in a vacuum atmosphere. The heat treatment is preferably performed at a pressure of $3\times10^{-7}$ or less Torr in a vacuum atmosphere, most preferably at a pressure of $3\times10^{-8}$ Torr or less in a vacuum atmosphere if possible. In addition, in the case where the electroluminescent layer 426 is deposited after the heat treatment is performed in a vacuum atmosphere, the reliability of the display device can be further improved by putting the substrate in the vacuum atmosphere just before the deposition of the electroluminescent layer 426. Further, the pixel electrode 424 may be irradiated with an ultraviolet ray before or after the vacuum baking.

Figure 33B:
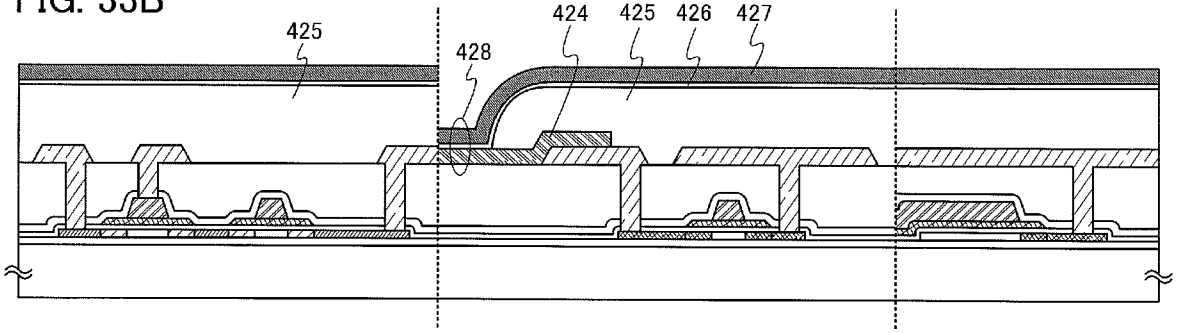

Next, as shown in FIG. 33B, the electroluminescent layer 426 is formed so as to be in contact with the pixel electrode 424 in the opening portion of the partition 425. The electroluminescent layer 426 may be formed using either a single layer or by stacking a plurality of layers; and an inorganic material as well as an organic material may be included in each layer. Luminescence of the electroluminescent layer 426 refers to light emission (fluorescence) in returning from a singlet-excited state to a ground state and light emission (phosphorescence) in returning from a triplet-excited state to a ground state. In the case where the electroluminescent layer 426 is formed using a plurality of layers, an electron injection layer, an electron transport layer, a light-emitting layer, a hole transport layer, and a hole injection layer are stacked in that order over the pixel electrode 424 which corresponds to a cathode. Note that in the case where the pixel electrode 424 corresponds to an anode, the electroluminescent layer 426 is formed by stacking a hole injection layer, a hole transport layer, a light-emitting layer, an electron transport layer, and an electron injection layer in that order.

Alternatively, the electroluminescent layer 426 can be formed by a droplet discharge method by using any of a high-molecular organic compound, an intermediate-molecular organic compound (an organic compound having no sublimation property and having a molecular chain length of 10 μm or less), a low-molecular organic compound, and an inorganic compound. Further, an intermediate-molecular organic compound, a low-molecular organic compound, and an inorganic compound may be formed by vapor deposition.

Next, the common electrode 427 is formed so as to cover the electroluminescent layer 426. For the common electrode 427, a metal, an alloy, or an electroconductive compound, which generally has a small work function, a mixture thereof, or the like can be used. Specifically, the common electrode 427 can be formed using an alkali metal such as Li or Cs; an alkaline earth metal such as Mg, Ca, or Sr; an alloy containing any of these metals (e.g., Mg:Ag or Al:Li); or a rare earth metal such as Yb or Er. Further, by forming a layer containing a material having a high electron injection property so as to be in contact with the common electrode 427, a normal conductive film formed using aluminum, a light-transmitting oxide conductive material, or the like can be used.

The pixel electrode 424, the electroluminescent layer 426, and the common electrode 427 overlap with each other in the opening portion of the partition 425, so that a light-emitting element 428 is formed.

Note that light from the light-emitting element 428 may be extracted from the pixel electrode 424 side, the common electrode 427 side, or both sides. In accordance with an objective structure among the three structures described above, the material and the thickness of each of the pixel electrode 424 and the common electrode 427 are selected.

Note that an insulating film may be formed over the common electrode 427 after the light-emitting element 428 is formed. As the insulating film, a film through which a substance that causes increase in deterioration of a light-emitting element, such as moisture or oxygen, penetrates in smaller amount than those of other insulating films is used. Typically, for example, a DLC film, a carbon nitride film, a silicon nitride which is formed by RF sputtering, or the like is preferably used. Alternatively, the above film through which a substance such as moisture or oxygen penetrates in smaller amount and a film through which a substance such as moisture or oxygen penetrates in larger amount than that of the film are stacked so that the films can be used as the above insulating film.

Note that in practice, after the formation of the display device reach the state shown in FIG. 33B, packaging (encapsulation) is preferably performed using a protective film (e.g., an attachment film or an ultraviolet curable resin film) or a cover material, which has high airtightness and causes less degassing, so that additional exposure to the air is prevented.

The above process enables the display device that is one embodiment of the present invention to be fabricated.

Note that although the fabrication method of the semiconductor element in the pixel area is described in this embodiment, a transistor used for a driver circuit or an integrated circuit can be formed together with the transistors in the pixel area. In this case, it is not necessary that the thickness of the gate insulating film 410 be the same in all of the transistors in the pixel area and the transistor used for the driver circuit or the integrated circuit. For example, in the transistor used for the driver circuit or the integrated circuit, which needs to be operated at high speed, the thickness of the gate insulating film 410 may be smaller than that of the transistors in the pixel area.

Further, by using an SOI (silicon on insulator) substrate, a single crystal semiconductor can be used for the semiconductor element. An SOI substrate can be fabricated using, for example, an attachment method such as UNIBOND (registered trademark) typified by Smart Cut (registered trademark), epitaxial layer transfer (ELTRAN), a dielectric separation method, or plasma assisted chemical etching (PACE); separation by implanted oxygen (SIMOX); or the like.

By transferring the semiconductor element fabricated using the above method to a flexible substrate such as a plastic substrate, the display device may be formed. Examples of the transferring method include: a method by which a metal oxide film is formed between the substrate and the semiconductor element and the metal oxide film is weakened by crystallization so that the semiconductor element is separated from the substrate and transferred; a method by which an amorphous silicon film containing hydrogen is provided between the substrate and the semiconductor element and the amorphous silicon film is removed by laser light irradiation or etching so that the semiconductor element is separated from the substrate and transferred; and a method by which the substrate over which the semiconductor element is formed is mechanically removed or is removed by etching with a solution or a gas so that the semiconductor element is separated from the substrate and transferred. Note that the semiconductor element is preferably transferred before the light-emitting element is fabricated.

This embodiment can be implemented in combination as appropriate with any of the above-described embodiments.

Embodiment 10

Figure 34A:
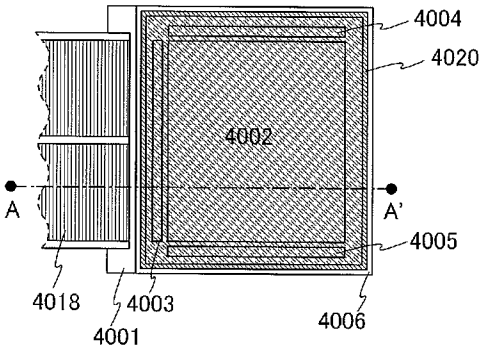
FIGS. 34A and 34B show an example of a top view and a cross-sectional view of a display device.
Figure 34B:
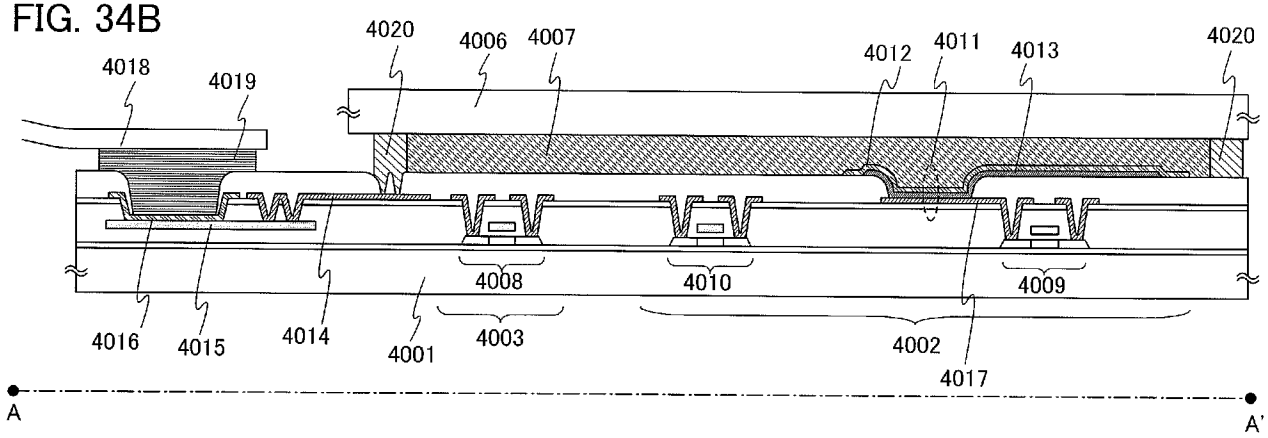

The appearance of a display device that is one embodiment of the present invention will be described with reference to FIGS. 34A and 34B. FIG. 34A is a top view of a panel in which a transistor and a light-emitting element which are formed over a first substrate are sealed between the first substrate and a second substrate with a sealant. FIG. 34B is a cross-sectional view taken along line A-A' in FIG. 34A.

A sealant 4020 is provided so as to surround a pixel area 4002, a signal line driver circuit 4003, a scan line driver circuit 4004, and a scan line driver circuit 4005 which are provided over a first substrate 4001. Further, a second substrate 4006 is provided over the pixel area 4002, the signal line driver circuit 4003, the scan line driver circuit 4004, and the scan line driver circuit 4005. Thus, the pixel area 4002, the signal line driver circuit 4003, the scan line driver circuit 4004, and the scan line driver circuit 4005 are sealed together with a filler 4007 between the first substrate 4001 and the second substrate 4006 with the sealant 4020.

Each of the pixel area 4002, the signal line driver circuit 4003, the scan line driver circuit 4004, and the scan line driver circuit 4005 which are formed over the first substrate 4001 has a plurality of transistors. In FIG. 34B, a transistor 4008 included in the signal line driver circuit 4003, and a transistor 4009 and a transistor 4010 which are included in the pixel area 4002 are shown.

In addition, part of a wiring 4017 which is connected to a source region or a drain region of the transistor 4009 is used as a pixel electrode of a light-emitting element 4011. Further, the light-emitting element 4011 includes a common electrode 4012 and an electroluminescent layer 4013 in addition to the pixel electrode. Note that the structure of the light-emitting element 4011 is not limited to the structure shown in this embodiment. Note that the structure of the light-emitting element 4011 is not limited to the structure shown in this embodiment. The structure of the light-emitting element 4011 can be changed as appropriate in accordance with the direction of light extracted from the light-emitting element 4011, polarity of the thin film transistor 4009, or the like.

Signals and voltages supplied to the signal line driver circuit 4003, the scan line driver circuit 4004, the scan line driver circuit 4005, or the pixel area 4002 are, although not shown in the cross-sectional view shown in FIG. 34B, supplied from a connection terminal 4016 through lead wirings 4014 and 4015.

In this embodiment, the connection terminal 4016 is formed using the same conductive film as the common electrode 4012 included in the light-emitting element 4011. In addition, the lead wiring 4014 is formed using the same conductive film as the wiring 4017. Further, the lead wiring 4015 is formed using the same conductive film as gate electrodes of the transistor 4009, the transistor 4010, and the transistor 4008.

The connection terminal 4016 is electrically connected to a terminal of an FPC 4018 through an anisotropic conductive film 4019.

Note that for each of the first substrate 4001 and the second substrate 4006, glass, metal (typically stainless steel), ceramics, or plastics can be used. Note that the second substrate 4006 which is in a direction from which light from the light-emitting element 4011 is extracted needs to have a light-transmitting property. Thus, a light-transmitting material such as a glass plate, a plastic plate, a polyester film, or an acrylic film is preferably used for the second substrate 4006.

In addition, as well as inert gas such as nitrogen or argon, an ultraviolet curable resin or a thermosetting resin can be used for the filler 4007. In this embodiment, an example in which nitrogen is used for the filler 4007 is shown.

This embodiment can be implemented in combination as appropriate with any of the above-described embodiments.

Embodiment 11

It is possible to provide, as an example of a display device that is one embodiment of the present invention, a display device having a large screen, in which high-definition images can be displayed and power consumption can be reduced. Thus, a display device that is one embodiment of the present invention is preferably used for display devices, laptops, or image reproducing devices provided with recording media (typically devices which reproduce the content of recording media such as DVDs (digital versatile disc) and have displays for displaying the reproduced images). Further, examples of an electronic appliance which can use the display device that is one embodiment of the present invention include a cellular phone, a portable game machine, an e-book reader, a camera such as a video camera or a digital still camera, a goggle-type display (a head mounted display), a navigation system, and an audio reproducing device (e.g., a car audio or an audio component set). Specific examples of these electronic appliances are shown in FIGS. 35A to 35C.

Figure 35A:
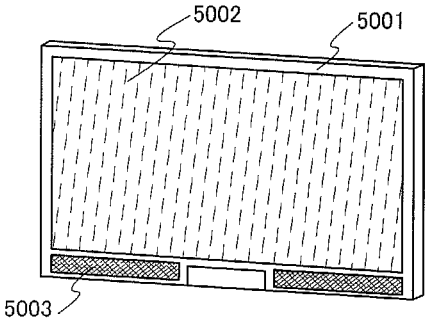
FIGS. 35A to 35C are diagrams each showing an example of an electronic appliance using a display device.

FIG. 35A shows a display device, which includes a housing 5001, a display portion 5002, a speaker portion 5003, and the like. The display device that is one embodiment of the present invention can be used for the display portion 5002. Note that a display device includes all display devices for displaying information, such as display devices for personal computers, for receiving television broadcast, and for displaying advertisement, in its category.

Figure 35B:
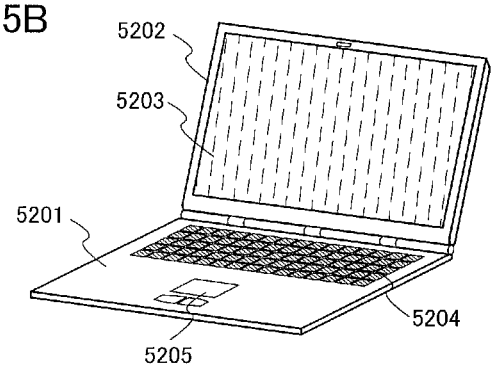

FIG. 35B shows a laptop, which includes a main body 5201, a housing 5202, a display portion 5203, a keyboard 5204, a mouse 5205, and the like. The display device that is one embodiment of the present invention can be used for the display portion 5203.

Figure 35C:
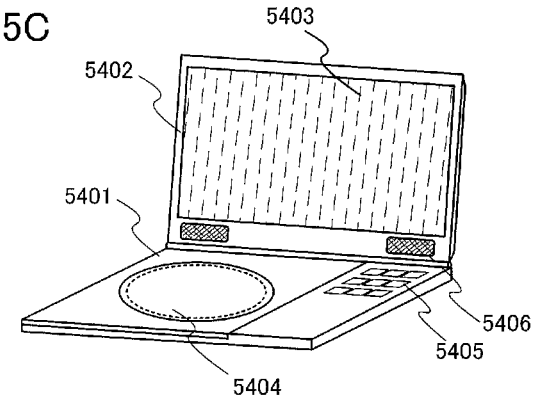

FIG. 35C shows a portable image reproducing device provided with a recording medium (specifically a DVD player), which includes a main body 5401, a housing 5402, a display portion 5403, a recording medium (e.g., a DVD) reading portion 5404, an operation key 5405, a speaker portion 5406, and the like. An image reproducing device provided with a recording medium includes a home-use game machine in its category. The display device that is one embodiment of the present invention can be used for the display portion 5403.

As described above, the display device that is one embodiment of the present invention is capable of extremely wide application and is applicable to all types of electronic appliances.

This embodiment can be implemented in combination as appropriate with any of the above-described embodiments.

This application is based on Japanese Patent Application serial no. 2010-010287 filed with Japan Patent Office on Jan. 20, 2010, the entire contents of which are hereby incorporated by reference.

What is claimed is:

1. A display device comprising:

a pixel comprising:

a transistor;

a capacitor having one terminal electrically connected to a first line, and the other terminal electrically connected to a gate of the transistor; and a display element, wherein in a first period, an electrical continuity between a first terminal of the transistor and the gate of the transistor is established, an electrical continuity between the first terminal of the transistor and the first line is not established, an electrical continuity between the gate of the transistor and a second line is established, an electrical continuity between a second terminal of the transistor and a third line is not established, and an electrical continuity between the second terminal of the transistor and the display element is not established, wherein in a second period, an electrical continuity between the first terminal of the transistor and the gate of the transistor is established, an electrical continuity between the first terminal of the transistor and the first line is not established, an electrical continuity between the gate of the transistor and the second line is not established, an electrical continuity between the second terminal of the transistor and the third line is established, and an electrical continuity between the second terminal of the transistor and the display element is not established, wherein in a third period, an electrical continuity between the first terminal of the transistor and the gate of the transistor is not established, an electrical continuity between the first terminal of the transistor and the first line is established, an electrical continuity between the gate of the transistor and the second line is not established, an electrical continuity between the second terminal of the transistor and the third line is not established, and an electrical continuity between the second terminal of the transistor and the display element is established, and wherein in the first to third periods, a fixed potential is applied to the first line.

2. The display device according claim 1, wherein a video signal is input to the third line.

3. The display device according to claim 1, wherein a fixed potential is applied to the second line.

4. A display device comprising:

a pixel comprising:

a transistor;

a capacitor having one terminal electrically connected to a first line, and the other terminal electrically connected to a gate of the transistor;

a display element; and first to fifth switches, wherein a first terminal of the transistor is electrically connected to the gate of the transistor through the first switch, wherein the first terminal of the transistor is electrically connected to the first line directly through the second switch, wherein the gate of the transistor is electrically connected to a second line directly through the third switch, wherein a second terminal of the transistor is electrically connected to a third line directly through the fourth switch, wherein the second terminal of the transistor is electrically connected to the display element through the fifth switch, wherein in a first period, an electrical continuity between the first terminal of the transistor and the gate of the transistor is established, an electrical continuity between the first terminal of the transistor and the first line is not established, an electrical continuity between the gate of the transistor and the second line is established, an electrical continuity between the second terminal of the transistor and the third line is not established, and an electrical continuity between the second terminal of the transistor and the display element is not established, wherein in a second period, an electrical continuity between the first terminal of the transistor and the gate of the transistor is established, an electrical continuity between the first terminal of the transistor and the first line is not established, an electrical continuity between the gate of the transistor and the second line is not established, an electrical continuity between the second terminal of the transistor and the third line is established, and an electrical continuity between the second terminal of the transistor and the display element is not established, wherein in a third period, an electrical continuity between the first terminal of the transistor and the gate of the transistor is not established, an electrical continuity between the first terminal of the transistor and the first line is established, an electrical continuity between the gate of the transistor and the second line is not established, an electrical continuity between the second terminal of the transistor and the third line is not established, and an electrical continuity between the second terminal of the transistor and the display element is established, and wherein in the first to third periods, a fixed potential is applied to the first line.

5. The display device according claim 4, wherein a video signal is input to the third line.

6. The display device according to claim 4, wherein a fixed potential is applied to the second line.

7. The display device according to claim 4, wherein one terminal of the first switch is directly connected to the first terminal of the transistor, and wherein the other terminal of the first switch is directly connected to the gate of the transistor.

8. The display device according to claim 4, wherein one terminal of the second switch is directly connected to the first terminal of the transistor, and wherein the other terminal of the second switch is directly connected to the first line.

9. The display device according to claim 4, wherein one terminal of the third switch is directly connected to the gate of the transistor, and wherein the other terminal of the third switch is directly connected to the second line.

10. The display device according to claim 4, wherein one terminal of the fourth switch is directly connected to the second terminal of the transistor, and wherein the other terminal of the fourth switch is directly connected to the third line.

11. The display device according to claim 4, wherein one terminal of the fifth switch is directly connected to the second terminal of the transistor, and wherein the other terminal of the fifth switch is directly connected to the display element.

* * * * *